US010120296B2

(12) United States Patent
Matsushima et al.

(10) Patent No.: US 10,120,296 B2
(45) Date of Patent: Nov. 6, 2018

(54) ELECTROSTATIC LATENT IMAGE DEVELOPING TONER

(71) Applicant: Konica Minolta, Inc., Tokyo (JP)

(72) Inventors: Kaori Matsushima, Hino (JP); Noboru Ueda, Mitaka (JP); Shiro Hirano, Hachioji (JP); Kouji Sugama, Musashino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/710,259

(22) Filed: Sep. 20, 2017

(65) Prior Publication Data

US 2018/0088477 A1 Mar. 29, 2018

(30) Foreign Application Priority Data

Sep. 29, 2016 (JP) ..... 2016-190877

(51) Int. Cl.
*G03G 9/087* (2006.01)
*G03G 9/08* (2006.01)

(52) U.S. Cl.
CPC ..... *G03G 9/08755* (2013.01); *G03G 9/0821* (2013.01); *G03G 9/0825* (2013.01); *G03G 9/08728* (2013.01); *G03G 9/08788* (2013.01); *G03G 9/08795* (2013.01); *G03G 9/08797* (2013.01)

(58) Field of Classification Search
CPC ..... G03G 9/08791; G03G 9/08788; G03G 9/08755; G03G 9/08782; G03G 9/0825; G03G 9/08711; G03G 9/08784; G03G 9/0821
See application file for complete search history.

(56) References Cited

U.S. PATENT DOCUMENTS 6,096,468 A * 8/2000 Ohno ..... G03G 9/0819 430/108.3
2015/0177634 A1* 6/2015 Kamae ..... G03G 9/08748 430/108.4
2016/0091813 A1* 3/2016 Yoshiba ..... G03G 9/08797 430/109.4

FOREIGN PATENT DOCUMENTS

JP 2014174244 A 9/2014
JP 2015179108 A 10/2015

* cited by examiner

*Primary Examiner* — Janis L Dote
(74) *Attorney, Agent, or Firm* — Lucas & Mercanti, LLP

(57) ABSTRACT

An electrostatic latent image developing toner includes toner particles which comprises a binder resin and a releasing agent. A main component of the binder resin is a polyester resin. The binder resin comprises a crystalline polyester resin, an amorphous polyester resin and a hybrid vinyl resin. The hybrid vinyl resin is composed of a vinyl polymer segment and at least one segment selected from a polyester polymer segment, an urethane polymer segment and an urea polymer segment which is chemically bound to the vinyl polymer segment. A main component of the hybrid vinyl resin is the vinyl polymer segment which comprises a structural unit derived from a monomer having a specific structure. A tetrahydrofuran-soluble fraction of the toner has a main peak of a molecular weight distribution measured by gel permeation chromatography within the range of 11000 to 30000.

20 Claims, No Drawings

ELECTROSTATIC LATENT IMAGE DEVELOPING TONER

BACKGROUND

1. Technological Field

The present invention relates to an electrostatic latent image developing toner. In more detail, the present invention relates to an electrostatic latent image developing toner with which a fine image can be obtained without causing a transfer error or a fixing error.

2. Description of the Related Art

In order to achieve low-temperature fixing, toners containing a combination of an amorphous polyester resin and a crystalline polyester resin have been used. Since this type of toner exhibits a great decrease of the viscosity when heated at the nipping area of a fixing device, it is possible to fix the toner with relatively low thermal energy. However, problems with such toners are the decreased hardness of toner particles and the decreased toner resistance.

A technique that has been known to cope with the problems is to use a styrene acrylic resin containing 2-carboxyethyl acrylate as a polymer component in combination with an amorphous polyester resin and a crystalline polyester resin. With this technique, the high affinity among the three resins in the toner particles reduces collapse of the toner and improves the resin dispersion. For example, a technique for preventing uneven transfer and deterioration in image quality when folding an image have been disclosed (e.g. see JP 2015-179108A).

Another technique for low-temperature fixing known in the art is such that a toner contains a crystalline polyester resin, and the tetrahydrofuran (THF)-soluble fraction of the toner has the molecular weight distribution with a main peak between 1000 and 10000. However, in this resin composition, it is impossible to secure dispersion of the components since the kneading shear in a melt kneading step of grinded toner is decreased.

In this regard, a technique that has been disclosed is such that a complex resin containing a condensation polymer resin unit and an addition polymer resin unit is added to secure the kneading shear to achieve fine dispersion of a crystalline polyester resin. Furthermore, since the usage of a relatively hard complex resin makes a low-softening-point resin and the crystalline polyester resin less likely to be exposed in the interface of the grinded toner, the thermal storage stability can be secured and the change of the charge characteristic can be reduced (e.g. see JP 2014-174244A).

In recent years, high-quality images have been provided by using a variety of media, and decorative sheets such as embossed paper are sometimes used. Since the surface of such paper is uneven to a great degree, the distance to a transferring member or a fixing member inevitably differs between recesses and protrusions.

As a result, in the transferring step, the transferring current between the transferring member and an embossed paper is low in recesses and high in protrusions. When the charge characteristic of the toner is not uniform, the amount of toner transferred varies to a large extent according to the variation of the transferring current.

Further, in the fixing step, the heat energy and the pressure applied from the fixing nip are low in recesses and high in protrusions. When the releasing agent in the toner is not uniformly dispersed, it is impossible to achieve suitable fixability in both recesses and protrusions.

The usage of embossed paper is not considered in the above-described techniques known in the art. For embossed paper, it is required to further improve the charge characteristic and fixing characteristic. However, it cannot be said that sufficient dispersion of a releasing agent is not achieved in the prior art. Further, incorporation of a releasing agent into toner is not sufficient, and it is sometimes exposed in the toner surface or unevenly distributed inside the toner.

As a result, ununiform adhesion of an external additive causes the unstable charge characteristic and the insufficient fixability, which results in an image defect.

For example, addition of a styrene acrylic resin that contains a polymer component of 2-carboxyethyl acrylate as described in JP 2015-179108A is expected to produce an effect of dispersing a releasing agent as with crystalline polyester resins. However, typical releasing agents used in toners are more hydrophobic than crystalline polyester resins, and it is therefore difficult to disperse them sufficiently.

It is also a possible measure to improve the kneading shear by the presence of a complex resin as described in JP 2014-174244A. However, the dispersion is not sufficient to improve the uneven distribution of a releasing agent, and the releasing agent is exposed in the surface of grinded toner. As a result, it is impossible to prevent deterioration of the image quality.

SUMMARY

The present invention has been made in view of the above-described problems and the circumstances, and an object thereof is to provide an electrostatic latent image developing toner with which a fine image can be obtained without causing a transfer error or a fixing error.

The present inventors made a study on the cause of the above-described problems or the like in order to achieve the object and has found that fine images can be obtained without causing a transfer error or a fixing error when the electrostatic latent image developing toner of the present invention contains the hybrid vinyl resin, the main component of which is the vinyl polymer segment that has a structural unit derived from a monomer having a specific structure, and the tetrahydrofuran-soluble fraction of the toner has a main peak of the molecular weight distribution measured by gel permeation chromatography within a specific numerical range. The present invention has been thus completed.

That is, the object of the present invention is achieved by the following means.

To achieve at least one of the abovementioned objects, according to an aspect of the present invention, there is provided an electrostatic latent image developing toner, including:

toner particles which includes a binder resin and a releasing agent, wherein a main component of the binder resin is a polyester resin, wherein the binder resin comprises a crystalline polyester resin, an amorphous polyester resin and a hybrid vinyl resin, wherein the hybrid vinyl resin is composed of a vinyl polymer segment and at least one segment selected from a polyester polymer segment, an urethane polymer segment and an urea polymer segment which is chemically bound to the vinyl polymer segment, wherein a main component of the hybrid vinyl resin is the vinyl polymer segment, wherein the vinyl polymer segment comprises a structural unit derived from a monomer of a following formula (1).

$$H_2C{=}CR_1{-}COOR_2 \quad (1)$$

where $R_1$ is a hydrogen atom or a methyl group, and $R_2$ is a long-chain alkyl group of 6 carbon atoms or more, and wherein a tetrahydrofuran-soluble fraction of the toner has a main peak of a molecular weight distribution measured by gel permeation chromatography within a range of 11000 to 30000.

Preferably, an average circularity of the toner particles is within the range of 0.940 to 0.995, and a coefficient of variation of a number particle size distribution of the toner particles is equal to or less than 20%.

Preferably, the number of carbon atoms of the long-chain alkyl group of $R_2$ is equal to or less than 20.

Preferably, the number of carbon atoms of the long-chain alkyl group of $R_2$ is within the range of 8 to 18.

Preferably, the long-chain alkyl group of $R_2$ comprises a branched structure.

Preferably, the releasing agent comprises a hydrocarbon releasing agent.

Preferably, the releasing agent comprises an ester releasing agent.

Preferably, a content of the vinyl polymer segment of the hybrid vinyl resin is within the range of 1 to 49 mass % with respect to the binder resin.

Preferably, a content of the vinyl polymer segment of the hybrid vinyl resin is within the range of 5 to 20 mass % with respect to the binder resin.

Preferably, a content of the crystalline polyester resin is within the range of 1 to 30 mass % with respect to the binder resin.

Preferably, a content of the vinyl polymer segment in the hybrid vinyl resin is within the range of 65 to 90 mass %.

Preferably, said at least one segment selected from the polyester polymer segment, the urethane polymer segment and the urea polymer segment comprises the polyester polymer segment.

Preferably, the hybrid vinyl resin is a block copolymer of the vinyl polymer segment and said at least one segment selected from the polyester polymer segment, the urethane polymer segment and the urea polymer segment.

Preferably, the hybrid vinyl resin comprises a main chain of the vinyl polymer segment and a side chain of said at least one segment selected from the polyester polymer segment, the urethane polymer segment and the urea polymer segment.

With the above-described means of the present invention, it is possible to provide an electrostatic latent image developing toner with which fine images can be obtained without causing a transfer error or a fixing error.

It has not been revealed yet how the present invention works or functions to produce the advantageous effects, but it is suggested as follows.

Since the hybrid vinyl resin according to the present invention has another polymer segment that is different from the vinyl polymer segment. e.g. a polyester polymer segment, it is compatible with the amorphous polyester resin and the crystalline polyester resin of the binder resin. Therefore, the hybrid vinyl resin and the crystalline polyester resin can be uniformly dispersed in the amorphous polyester resin. Further, since the hybrid vinyl resin includes the structural unit derived from the monomer of the formula (1) and has a long-chain alkyl group of 6 carbon atoms or more, it exhibits high hydrophobicity and high affinity for the releasing agent.

Since the hybrid vinyl resin contains the vinyl polymer segment as a main component, the ratio of the long-chain alkyl group in the hybrid vinyl resin is relatively high. In combination with the high affinity for the releasing agent, this enables uniform dispersion of the releasing agent in the binder resin.

When toner particles are heated in reaction solution in an aging step of the production or subjected to a heat treatment after grinding, a uniformly dispersed releasing agent may sometimes aggregate in the toner particles or bleed out to the toner surface.

In this regard, since the tetrahydrofuran (THF)-soluble fraction of the toner has a main peak of the molecular weight distribution of from 11000 to 30000, the resins in the toner particles exhibit suitable viscosity when the particles are heated. This can prevent the releasing agent in the toner particles from aggregating or bleeding out to the surface of the toner particles.

The above-described effects enable uniform dispersion of the releasing agent in the toner particles. As a result, non-uniform adhesion of an external additive can be prevented, and the charge characteristic can therefore be improved. Further, since the releasing agent is uniformly distributed, high image quality can be achieved even on highly uneven paper such as embossed paper.

DETAILED DESCRIPTION OF EMBODIMENTS

Hereinafter, one or more embodiments of the present invention will be described with reference to the drawings. However, the scope of the invention is not limited to the disclosed embodiments.

An electrostatic latent image developing toner according to the present invention includes toner particles which includes a binder resin and a releasing agent. A main component of the binder resin is a polyester resin. The binder resin comprises a crystalline polyester resin, an amorphous polyester resin and a hybrid vinyl resin. The hybrid vinyl resin is composed of a vinyl polymer segment and at least one segment selected from a polyester polymer segment, an urethane polymer segment and an urea polymer segment which is chemically bound to the vinyl polymer segment. A main component of the hybrid vinyl resin is the vinyl polymer segment which includes a structural unit derived from a monomer of a following formula (1).

$$H_2C{=}CR_1{-}COOR_2 \quad (1)$$

$R_1$ is a hydrogen atom or a methyl group, and $R_2$ is a long-chain alkyl group of 6 carbon atoms or more. A tetrahydrofuran-soluble fraction of the toner has a main peak of a molecular weight distribution measured by gel permeation chromatography within a range of 11000 to 30000. This feature is a common or corresponding technical feature of the following embodiments.

In an embodiment of the present invention, it is preferred that the average circularity of the toner particles is within the range of 0.940 to 0.995, and the coefficient of variation of the number particle size distribution of the toner particles is equal to or less than 20%. This is because within these ranges, toner particles can be prevented from tumbling or being scattered in a nip in a toner transferring step or a fixing step, and the dot reproducibility and the image quality can therefore be improved.

It is preferred that the number of carbon atoms in the long-chain alkyl group of $R_2$ is equal to or less than 20 since the hybrid vinyl resin is finely dispersed, and the dispersion of the releasing agent is improved accordingly. This is because when the number of carbon atoms is equal to or less than 20, the hybrid vinyl resin is not too hydrophobic and is compatible with the releasing agent.

In terms of achieving the advantageous effects of the present invention, it is preferred that the number of carbon atoms in the long-chain alkyl group of $R_2$ is within the range of 8 to 18.

It is preferred that the long-chain alkyl group of $R_2$ has a branched structure because the releasing agent is more likely to be trapped between the molecular chains, and the affinity for the releasing agent is therefore increased. This improves the dispersion of the releasing agent.

It is preferred that the releasing agent includes a hydrocarbon releasing agent because the releasing agent is uniformly dispersed and incorporated into the toner particles well and the fixability is therefore improved.

It is preferred that the releasing agent includes an ester releasing agent since the releasing agent is uniformly dispersed and incorporated into the toner particles well and the fixability is therefore improved.

It is preferred that the content of the vinyl polymer segment of the hybrid vinyl resin is within the range of 1 to 49 mass % with respect to the binder resin since the releasing agent can be suitably dispersed and incorporated and the ratio of the polyester resin in the hybrid vinyl resin falls within a suitable range. This can improve the fixability.

It is preferred that the content of the vinyl polymer segment of the hybrid vinyl resin is within the range of 5 to 20 mass % with respect to the binder resin in terms of achieving the advantageous effects of the present invention.

It is preferred that the content of the crystalline polyester resin is within the range of 1 to 30 mass % with respect to the binder resin since the fixability and the thermal storage stability can be further improved.

It is preferred that the content of the vinyl polymer segment in the hybrid vinyl resin is within the range of 65 to 90 mass % since the dispersion of the hybrid vinyl resin in the binder resin is improved and the affinity of the vinyl polymer segment for the releasing agent is increased, and the dispersion of the releasing agent is therefore improved.

It is preferred that said at least one segment selected from the polyester polymer segment, the urethane polymer segment and the urea polymer segment includes the polyester polymer segment since the hybrid vinyl resin is more compatible with the polyester resin and the dispersion of the hybrid vinyl resin is further improved.

It is preferred that the hybrid vinyl resin is a block copolymer of the vinyl polymer segment and said at least one segment selected from the polyester polymer segment, the urethane polymer segment and the urea polymer segment since the long-chain alkyl groups are close to each other when the vinyl polymer segment forms blocks, which increases the affinity with the releasing agent and improves the dispersion of the releasing agent.

It is preferred that the hybrid vinyl resin has a main chain of the vinyl polymer segment and a side chain of said at least one segment selected from the polyester polymer segment, the urethane polymer segment and the urea polymer segment since the long-chain alkyl groups are close to each other, which increases the affinity with the releasing agent and improves the dispersion of the releasing agent. Further, since the side chain is said polymer segment that is different from the vinyl polymer segment, the hybrid vinyl resin is compatible with the amorphous polyester resin and the crystalline polyester resin, and the dispersion of the hybrid vinyl resin is therefore improved.

Hereinafter the present invention and the components thereof, and embodiments for carrying out the present invention will be described in detail. As used herein, "to" is intended to mean that the numerical values before and after "to" are included as the lower and upper limits.

Summary of Electrostatic Latent Image Developing Toner

An electrostatic latent image developing toner according to the present invention includes toner particles which includes a binder resin and a releasing agent. A main component of the binder resin is a polyester resin. The binder resin comprises a crystalline polyester resin, an amorphous polyester resin and a hybrid vinyl resin. The hybrid vinyl resin is composed of a vinyl polymer segment and at least one segment selected from a polyester polymer segment, an urethane polymer segment and an urea polymer segment which is chemically bound to the vinyl poly mer segment. A main component of the hybrid vinyl resin is the vinyl polymer segment which includes a structural unit derived from a monomer of a following formula (1).

$$H_2C{=}CR_1{-}COOR_2 \quad (1)$$

$R_1$ is a hydrogen atom or a methyl group, and $R_2$ is a long-chain alkyl group of 6 carbon atoms or more. A tetrahydrofuran-soluble fraction of the toner has a main peak of a molecular weight distribution measured by gel permeation chromatography (GPC) within a range of 11000 to 30000.

The THF-soluble fraction of the electrostatic latent image developing toner of the present invention has a main peak of the molecular weight distribution by GPC within the range of 11000 to 30000.

As used herein, a main peak refers to a peak that has the largest area in a chart obtained by GPC.

With this molecular weight distribution, the resins in the toner particles can exhibit suitable melt viscosity even when they are heated in reaction solution in an aging step of the production by emulsion aggregation. Accordingly, the releasing agent, which is uniformly dispersed in the toner particles in the presence of the hybrid vinyl resin, can be retained inside the toner particles without causing bleed out to the particle surface. When the main peak is at less than 11000, the mobility of the releasing agent is increased due to the too low melt viscosity. Accordingly, the releasing agent unfavorably aggregates to be unevenly distributed or bleeds out to the toner surface. When the main peak is at greater than 30000, the toner particles do not melt by heat in a fixing nip, and the fixability is not secured.

GPC Measuring Method

For the GPC measurement, a high-speed GPC device (e.g. "HLC-8120 GPC" (TOSOH Corporation) and the columns "TSK GUARD COLUMN+TSK GEL SUPER HZM-MX3 (TOSOH Corporation) can be used.

The column temperature is maintained at 40° C. tetrahydrofuran (THF) is fed as carrier solvent at a flow rate of 0.2 mL/min. A measurement sample is dissolved into tetrahydrofuran to a concentration of 1 mg/mL by a treatment with an ultrasonic disperser at room temperature for 5 minutes.

Then, the solution is filtered through a membrane filter with a pore size of 0.2 μm so that sample solution is obtained. An aliquot (10 μL) of the sample solution is injected into the device along with the carrier solvent and is detected with a refractive index detector (RI detector). The molecular weight distribution of the measurement sample can be calculated by using a calibration curve that is determined by using mono-dispersed polystyrene standard particles. Ten polystyrenes are used for determining the calibration curve.

Crystalline Polyester Resin

The crystalline polyester resin is synthesized from a diacid (dicarboxylic acid) component and a dialcohol (diol) component. A crystalline polyester refers to a polyester that exhibits no stepwise change of heat absorption but an obvious endothermic peak in differential scanning calorimetry (DSC).

When used for electrostatic latent image developing toners, the term "crystalline" means that an obvious endothermic peak is observed in differential scanning calorimetry (DSC). Specifically, it means that the full width at half maximum of the endothermic peak measured at a heating rate of 10° C./min is equal to or less than 15° C.

Specifically, more preferred crystalline polyester resins are aliphatic crystalline polyester resins that have suitable melting point and an alkyl group of 4 carbon atoms or more. Polyester resins having an alkyl group of 4 carbon atoms or more can be obtained when a polymerizable monomer having an alkyl group of 4 carbon atoms or more is used as the above-described polycarboxylic acid or polyalcohol. However, the production method is not limited thereto.

The crystalline polyester resin is not particularly limited, and crystalline polyester resins known in the field of the present invention can be used. In the present invention, a resin in which a different component is bound to the crystalline polyester polymer segment in the ratio of 50 mass % or less is also referred to as crystalline polyester resin.

Dicarboxylic Acid

Dicarboxylic acids that can be used in the present invention are desirably aliphatic dicarboxylic acids, particularly straight chain carboxylic acids. Examples of such straight chain carboxylic acids include oxalic acid, malonic acid, succinic acid, glutaric acid, adipic acid, pimelic acid, suberic acid, azelaic acid, sebacic acid, 1,9-nonane dicarboxylic acid, 1,10-decane dicarboxylic acid, 1,11-undecane dicarboxylic acid, 1,12-dodecane dicarboxylic acid, 1,13-tridecane dicarboxylic acid, 1,14-tetradecane dicarboxylic acid, 1,18-octadecane dicarboxylic acid, 1,20-eicosane dicarboxylic acid, and the lower alkyl esters thereof and the anhydrides thereof. They can be used alone or in combination of two or more.

Dialcohol

Aliphatic dialcohols are preferred, examples of which include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-dodecanediol, 1,12-undecanediol, 1,13-tridecanediol, 1,14-tetradecanediol, 1,18-octadecanediol, 1,20-eicosanediol and the like. They can be used alone or in combination of two or more.

Melting Point (Tm)

The melting point of the crystalline polyester resin is preferably within the range of 55° C. to 85° C., more preferably within the range of 60° C. to 80° C. Melting point (Tm) is measured with a differential scanning calorimeter (e.g. "DIAMOND DSC" (PerkinElmer Co., Ltd.)) in the measurement conditions (heating and cooling conditions) that follows a first heating step from 0° C. to 200° C. at a heating rate of 10° C./min, a cooling step from 200° C. to 0° C. at a cooling rate of 10° C./min and a second heating step from 0° C. to 200° C. at a heating rate of 10° C./min in the written order. Based on the DSC curve obtained by the measurement, the melting point (Tm) is defined as the endothermic peak top temperature of crystalline polyester resin in the first heating step. Regarding the measurement procedure, 3.0 mg of a measurement sample (crystalline polyester resin) is sealed in an aluminum pan and is set in the sample holder of a DIAMOND DSC. An empty aluminum pan is used as a reference.

Molecular Weight Measured by Gel Permeation Chromatography (GPC)

It is preferred that the crystalline polyester resin has a weight average molecular weight (Mw) within the range of 5000 to 30000 and a number average molecular weight (Mn) within the range of 2000 to 50000. Within these ranges, an advantageous effect of low-temperature fixability is obtained. To measure these molecular weights, the same method as for the crystalline polyester resin is employed.

Amorphous Polyester Resin

The amorphous polyester resin is a type of known polyester resin obtained by polycondensation reaction of a di- or more carboxylic acid component (polycarboxylic acid component) and a di- or more alcohol component (polyalcohol component) that does not exhibit an obvious melting point but has relatively high glass transition point (Tg).

This property can be confirmed by differential scanning calorimetry (DSC). Further, since the monomer unit of the amorphous polyester resin is different from that of the crystalline polyester resin, the amorphous polyester resin can be distinguished from the crystalline polyester resin by, for example, an NMR analysis.

The amorphous polyester resin is not particularly limited, and amorphous polyester resins known in the field of the present invention can be used.

The amorphous polyester resin according to the present invention may be a resin to which another component is bound in the amount of less than 50 mass %.

Polycarboxylic Acid

Unsaturated aliphatic polycarboxylic acids, aromatic polycarboxylic acids and the derivatives thereof are preferably used. As long as an amorphous resin can be formed, saturated aliphatic polycarboxylic acids may also be used in combination. Examples of unsaturated aliphatic polycarboxylic acids include methylene succinic acid, fumaric acid, maleic acid, 3-hexenedioic acid, 3-octenedioic acid, unsaturated aliphatic dicarboxylic acids such as succinic acid substituted with an alkyl group of 1 to 20 carbon atoms or alkenyl group of 2 to 20 carbon atoms, 3-butene-1,2,3-tricarboxylic acid, 4-pentene-1,2,4-tricarboxylic acid, unsaturated aliphatic tricarboxylic acids such as aconitic acid, unsaturated aliphatic tetracarboxylic acids such as 4-pentene-1,2,3,4-tetracarboxylic acid, and the like. Further, lower alkyl esters and anhydrides of these compounds can also be used.

Specific examples of succinic acid that is substituted with an alkyl group of 1 to 20 carbon atoms or an alkenyl group of 2 to 20 carbon atoms include dodecyl succinic acid, dodecenyl succinic acid, octenyl succinic acid and the like. Further, lower alkyl esters and anhydrides of these compounds can also be used.

Examples of aromatic polycarboxylic acids include aromatic dicarboxylic acids such as phthalic acid, terephthalic acid, isophthalic acid, t-butylisophthalic acid, tetrachlorophthalic acid, chlorophthalic acid, nitrophthalic acid, p-phenylenediacetic acid, 2,6-naphthalenedicarboxylic acid, 4,4'-biphenyldicarboxylic acid and anthracene dicarboxylic acid; aromatic tricarboxylic acids such as 1,2,4-benzenetricarboxylic acid (trimellitic acid), 1,2,5-benzenetricarboxylic acid (trimesic acid), 1,2,4-naphthalenetricarboxylic acid and hemimellitic acid; aromatic tetracarboxylic acids such as pyromellitic acid and 1,2,3,4-butanetetracarboxylic acid;

aromatic hexacarboxylic acids such as mellitic acid, and the like. Further, lower alkyl esters and anhydrides of these compounds can be used.

Examples of saturated aliphatic polycarboxylic acids include the saturated aliphatic dicarboxylic acids listed in the section "crystalline polyester resin".

The number of carbon atoms of the dicarboxylic acids is not particularly limited. However, in terms of ease of optimization of the thermal properties, the number of carbon atoms is preferably within the range of 1 to 20, more preferably within the range of 2 to 15, particularly within the range of 3 to 12. The dicarboxylic acid component is not limited to a single compound and may be a mixture of two or more compounds.

The number of carbon atoms in the tri- or more carboxylic acids is not particularly limited. However, in terms of ease of optimization of the thermal properties, the number of carbon atoms is preferably within the range of 3 to 20, more preferably within the range of 5 to 15, particularly within the range of 6 to 12.

The polycarboxylic acid component is not limited to a single compound and may be a mixture of two or more compounds.

Polyalcohol

In terms of the charge characteristic and the strength of the toner, preferred polyalcohols that can be used in the present invention are unsaturated aliphatic polyalcohols, aromatic polyalcohols and the derivatives thereof. As long as the amorphous polyester resin can be formed, saturated aliphatic alcohols may also be used in combination.

Examples of unsaturated aliphatic polyalcohols include unsaturated aliphatic diols such as 2-butene-1,4-diol, 3-butene-1,4-diol, 2-butyne-1,4-diol, 3-butyne-1,4-diol and 9-octadecene-7,12-diol glycerin, trimethylolpropane, pentaerythritol, sorbitol and the like. Further, derivatives of these compounds can also be used.

Examples of aromatic polyalcohols include bisphenols such as bisphenol A and bisphenol F; alkylene oxide adducts of the bisphenols such as ethylene oxide adducts and propylene oxide adducts; 1,3,5-benzenetriol, 1,2,4-benzenetriol, 1,3,5-trihydroxy methylbenzene and the like. Further, derivatives of these compounds can also be used.

Among them, bisphenol A-based compounds such as ethylene oxide adduct and propylene oxide adduct of bisphenol A are preferably used in terms of particularly improving the charge uniformity and ease of optimization of the thermal properties of the toner.

The polyalcohol component is not limited to a single compound and may be a mixture of two or more compounds.

The number of carbon atoms in tri- or more alcohols is not particularly limited. However, in terms of ease of optimization of the thermal properties, the number of carbon atoms are preferably from 3 to 20.

Glass Transition Point (Tg)

The glass transition point of the amorphous polyester resin of the present invention is preferably within the range of 30° C. to 80° C. more preferably within the range of 40° C. to 64° C.

Glass transition point (Tg) can be measured by differential scanning calorimetry (DSC). Specifically, it is measured with a "DIAMOND DSC" (PerkinElmer Co., Ltd.) for example. The procedure and conditions of the measurement are the same as those for measuring the melting point of the above-described crystalline polyester resin. The data in the second heating step is analyzed, and the glass transition point is defined as the intersection between an extension of the baseline of the part before the rise of the first endothermic peak and the tangent with the maximum slope in the part from the rise of the first endothermic peak to the peak top.

Molecular Weight Measured by Gel Permeation Chromatography (GPC)

It is preferred that the amorphous polyester resin has a weight average molecular weight (Mw) within the range of 5000 to 30000 and a number average molecular weight (Mn) within the range of 2000 to 50000. Within these ranges, the advantageous effect of low-temperature fixability is obtained. To measure these molecular weights, the same method as for the above-described crystalline polyester resin is employed.

Softening Point (Tsc)

The softening point of the amorphous polyester resin of the present invention is preferably within the range of 80° C. to 120° C. more preferably within the range of 85° C. to 110° C. Within this range, the advantageous effect of low-temperature fixability is obtained. Softening point can be measured by the method described in the section of examples.

Method of Producing Crystalline Polyester Resin and Amorphous Polyester Resin

The content of the crystalline polyester resin is preferably within the range of 1 to 30 mass % with respect to the binder resin.

The method of producing the crystalline polyester resin and the amorphous polyester resin is not particularly limited, and they can be produced by polycondensation (esterification) of the polycarboxylic acid component and the polyalcohol component by using a known esterification catalyst.

The use ratio of the polyalcohol component and the polycarboxylic acid component is not particularly limited. However, the equivalent ratio OH/COOH of the polyalcohol component to the polycarboxylic acid component is preferably from 1.5/1 to 1/1.5, more preferably from 1.2/1 to 1/1.2.

Catalysts that can be used in the production include compounds of alkali metals such as sodium and lithium, compounds containing Group-II elements such as magnesium and calcium, compounds of metals such as aluminum, zinc, manganese, antimony, titanium, tin, zirconium and germanium, phosphite compounds, phosphate compounds, amine compounds and the like.

Specifically, examples of tin compounds include dibuthyltin oxide, tin octylate, tin dioctylate, the salts thereof, and the like.

Examples of titanium compounds include titanium alkoxides such as tetra-n-butyl titanate, tetra-t-buthyl titanate, tetra-isopropyl titanate, tetramethyl titanate and tetrastearyl titanate; titanium acylates such as polyhydroxytitanium stearate; titanium chelates such as titanium tetraacetyl acetonate, titanium lactate and titanium triethanolaminate; and the like.

Examples of germanium compounds include germanium dioxide and the like. Examples of aluminum compounds include oxides such as aluminum polyhydroxide, aluminum alkoxide and the like as well as tributyl aluminate. These compounds can be used alone or in combination of two or more.

The temperature in the polycondensation (esterification) is preferably within the range of 150° C. to 250° C. although it is not particularly limited. The reaction time of the polycondensation (esterification) is preferably within the range of 0.5 to 30 hours although it is not particularly limited. During the polycondensation, the pressure in the reaction system may be reduced according to need.

Hybrid Vinyl Resin

The hybrid vinyl resin according to the present invention includes a hybrid vinyl resin that is composed of a vinyl polymer segment and another polymer segment different from the vinyl polymer segment (hereinafter referred to as a non-vinyl polymer segment) that is chemically bound to the vinyl polymer segment. The main component of the hybrid vinyl resin is the vinyl polymer segment that includes a structural unit derived from a monomer having the structure of the following formula (1).

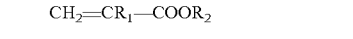

$$CH_2{=}CR_1{-}COOR_2 \quad (1)$$

In the formula (1), $R_1$ is a hydrogen atom or a methyl group, and $R_2$ is a long-chain alkyl group of 6 carbon atoms or more.

As used herein, the term "main component" means that the ratio of the component is equal to or greater than 50% in the composition.

It is preferred that the hybrid vinyl resin of the present invention has a polyester polymer segment since it is compatible with the amorphous polyester resin and the crystalline polyester resin of the binder resin. The combination use of these three resins enables their uniform distribution in the toner particles. Further, since the long-chain alkyl group moiety ($R_2$) in the structure of the formula (1) is relatively hydrophobic and has high affinity for the also hydrophobic releasing agent, the releasing agent can be uniformly dispersed inside the toner particles.

Since the hybrid resin has the vinyl polymer segment as the main component, the ratio of the long-chain alkyl group moiety ($R_2$) is relatively high, which can increase the affinity for the releasing agent and promote the uniform dispersion. When the number of carbon atoms in the long-chain alkyl group moiety ($R_2$) is less than 6, the releasing agent aggregates in the toner particles due to the insufficient affinity for the releasing agent and cannot remain in a finely dispersed state. As a result, the distribution becomes ununiform.

The number of carbon atoms in the long-chain alkyl group moiety of $R_2$ is preferably equal to or less than 20, more preferably within the range of 8 to 18. When the number of carbon atoms is equal to or less than 20, the hybrid vinyl resin is not too hydrophobic and compatible with the releasing agent. Furthermore, the hybrid vinyl resin exhibits good dispersion, which improves the dispersion of the releasing agent.

It is preferred that the long-chain alkyl group of $R_2$ has a branched structure, since the dispersion of the releasing agent is improved. This is because the releasing agent is more likely to be trapped between the molecular chains, and the affinity for the releasing agent is therefore improved.

Vinyl Polymer Segment

The hybrid vinyl resin according to the present invention is preferably a block copolymer of the vinyl polymer segment and the non-vinyl polymer segment. This is because when the vinyl polymer segment forms blocks, the mutually close long-chain alkyl groups increase the affinity for the releasing agent, and the dispersion of the releasing agent is therefore improved.

It is preferred that the hybrid vinyl resin has a main chain of the vinyl polymer segment and a side chain of the non-vinyl polymer segment. The mutually close long-chain alkyl groups increase the affinity for the releasing agent, and the dispersion of the releasing agent is therefore improved. The non-vinyl polymer segment as a side chain makes the hybrid vinyl resin more compatible with the amorphous polyester resin and the crystalline polyester resin, and the dispersion of the hybrid vinyl resin is therefore improved.

The vinyl polymer segment of the hybrid vinyl resin is composed of a vinyl resin that is obtained by polymerization of a vinyl monomer. Specific examples of such hybrid vinyl resins include acrylic resins, styrene-acrylic acid copolymer resins and the like.

The vinyl monomer of the vinyl polymer segment is one or more monomers selected from the following monomers.

(1) Styrene Monomers

Examples are styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene, and the derivatives thereof, and the like.

(2) (Meth)Acrylate Monomers

Examples are methyl (meth)acrylate, ethyl (meth)acrylate, n-butyl (meth)acrylate, isopropyl (meth)acrylate, isobutyl (meth)acrylate, t-butyl (meth)acrylate, n-octyl (meth)acrylate, 2-ethylhexyl (meth)acrylate, stearyl (meth) acrylate, lauryl (meth)acrylate, phenyl (meth)acrylate, diethylaminoethyl (meth)acrylate, dimethylaminoethyl (meth) acrylate and the derivatives thereof, and the like.

When the substituent corresponding to $R_2$ of the formula (1) is a long-chain alkyl group of 6 carbon atoms or more, the above-described monomers fall in the monomers having the structure of the formula (1).

(3) Vinyl Esters

Examples are vinyl propionate, vinyl acetate, vinyl benzoate and the like.

(4) Vinyl Ethers

Examples are vinyl methyl ether, vinyl ethyl ether and the like.

(5) Vinyl Ketones

Examples are vinyl methyl ketone, vinyl ethyl ketone, vinyl hexyl ketone and the like.

(6) N-Vinyl Compounds

Examples are N-vinyl carbazole, N-vinyl indole, N-vinyl pyrrolidone and the like.

(7) Others

Examples are vinyl compounds such as acrylonitrile, vinyl naphthalene and vinyl pyridine; acrylate or methacrylate derivatives such as methacrylonitrile and acrylamide; and the like.

It is preferred that the vinyl monomer has an ionic dissociative group such as a carboxylic group, a sulfonic group or a phosphoric group. Specific examples of such monomers are the following compounds.

Examples of monomers having a carboxylic group include acrylic acid, methacrylic acid, maleic acid, itaconic acid, cinnamic acid, fumaric aid, monoalkyl malate, monoalkyl itaconate and the like. Examples of monomers having a sulfonic group include styrene sulfonic acid, aryl sulfosuccinic acid, 2-acrylamide-2-methylpropane sulfonic acid and the like. Examples of monomers having a phosphoric group include acid phosphooxymethyl methacrylate and the like.

Further, a multifunctional vinyl can be used as the vinyl monomer so that the vinyl resin has a branched structure. Such multifunctional vinyls include divinyl benzene, ethyleneglycol dimethacrylate, ethyleneglycol diacrylate, diethyleneglycol dimethacrylate, diethyleneglycol diacrylate, triethyleneglycol dimethacrylate, triethyleneglycol diacrylate, neopentylglycol dimethacylate, neopentylglycol diacrylate and the like.

The method of producing the vinyl polymer segment is not particularly limited. For example, any general polymerization initiator known in the art for polymerizing the above-described monomers such as peroxides, persulfides, persulfates and azo compounds is used to cause polymerization known in the art such as bulk polymerization, solution polymerization, emulsion polymerization, mini-emulsion polymerization or dispersion polymerization.

Non-Vinyl Polymer Segment

Examples of non-vinyl polymer segments that can be used in the present invention include a polyester polymer segment, an urethane polymer segment, an urea polymer segment and the like. Among them, a polyester polymer segment is preferred in terms of the adhesion to the polyester resin, which is the main component of the binder resin. The non-vinyl polymer segment according to the present invention may be a single polymer segment or include two or more types of polymer segments.

The content of the vinyl polymer segment in the hybrid vinyl resin is within the range of 50 to 99 mass %. Within this range, the non-vinyl polymer segment of the hybrid vinyl resin is less likely to be exposed in the surface of the toner particles, and the hybrid vinyl resin is uniformly dispersed in the polyester resin. Further, since the crystalline polyester resin is also compatible with the non-vinyl polymer segment, the stability of image quality is improved.

The content of the vinyl polymer segment in the hybrid vinyl resin is preferably within the range of 51 to 95 mass %, more preferably within the range of 65 to 90 mass %. Within this range, the dispersion of the hybrid vinyl resin in the binder resin is improved. Further, the dispersion of the releasing agent is also improved since the affinity of the vinyl polymer segment for the releasing agent is improved.

Specifically, the content of the vinyl polymer segment is determined based on the total mass of the resin components used in the synthesis of the hybrid vinyl resin. That is, the content of the vinyl polymer segment is defined as the ratio of the mass of the monomer constituting the vinyl polymer segment to the total mass of the vinyl monomer, the monomer constituting the non-vinyl polymer segment and an optional bi-reactive monomer and the like according to need.

For example, the components and the content of the vinyl polymer segment can be determined by an NMR measurement, a pyrolytic gas chromatography-mass spectrometry (Py-GC/MS) measurement or the like.

Glass Transition Point

The glass transition point of the hybrid vinyl resin according to the present invention is preferably within the range of 25° C. to 70° C. more preferably within the range of 35° C. to 65° C.

When the glass transition point of the hybrid vinyl resin is within this range, the sufficient low-temperature fixability and the sufficient thermal storage stability are both achieved. The glass transition point of the hybrid vinyl resin can be measured by the same method as for measuring the glass transition point of the above-described polyester resin.

Molecular Weight Measured by Gel Permeation Chromatography (GPC)

The weight average molecular weight (Mw) of the hybrid vinyl resin is preferably within the range of 5000 to 100000.

Polyester Polymer Segment

The polyester polymer segment of the hybrid vinyl resin is preferably composed of polyester resin that is produced by polycondensation reaction of a polycarboxylic acid and a polyalcohol in the presence of a catalyst. Specific compounds of polycarboxylic acids and polyalcohols have been already described above in the items of the crystalline polyester resin and the amorphous polyester resin, and the description is omitted here.

Bi-Reactive Monomer

The bi-reactive monomer binds the vinyl polymer segment to the polyester polymer segment, which has both a group constituting the polyester polymer segment selected from a hydroxy group, a carboxy group, an epoxy group and a primary or secondary amino group and an ethylenic unsaturated group constituting the vinyl polymer segment in a molecule. It is preferred that the bi-reactive monomer has a hydroxy or carboxy group and an ethylenic unsaturated group, more preferably a carboxy group and an ethylenic unsaturated group.

Specific examples of such bi-reactive monomers include acrylic acid, methacrylic acid, fumaric acid and maleic acid, and furthermore, hydroxyalkl (1 to 3 carbon atoms) esters of these acids. Among them, acrylic acid, methacrylic acid and fumaric acid are preferred in terms of the reactivity. Via the bi-reactive monomer, the vinyl polymer segment is bound to the polyester polymer segment.

In terms of improving the low-temperature fixability of the toner, the amount of bi-reactive monomer used is preferably within the range of 1 to 20 mass %, more preferably within the range of 4 to 15 mass % with respect to 100 mass % of the total mass of the vinyl monomer unit of the vinyl polymer segment.

Method of Producing Hybrid Vinyl Resin

The hybrid vinyl resin can be produced by a production method known in the art. The following two production methods are representative.

(1) The vinyl polymer segment is polymerized first, and the bi-reactive monomer is reacted with the vinyl polymer segment. Alternatively, the bi-reactive monomer is reacted with another monomer during the polymerization of the vinyl polymer segment. Then, the polycarboxylic acid and the polyalcohol for forming the polyester polymer segment are reacted therewith so that the polyester polymer segment is formed.

(2) The polyester polymer segment and the vinyl polymer segment are individually polymerized first. Then, the bi-reactive monomer is reacted therewith to bind them.

Among the above-described methods, the method (1) is preferred although any of them can be used for the present invention. Specifically, a preferred method is as follows. The polycarboxylic acid and the polyalcohol for forming the polyester polymer segment, the vinyl monomer for forming the vinyl polymer segment, and the bi-reactive monomer are mixed. A polymerization initiator is added thereto to cause addition polymerization of the vinyl monomer and the bi-reactive monomer so that the vinyl polymer segment is formed. Thereafter an esterification catalyst is added to cause polycondensation reaction.

The esterification catalyst for synthesizing the polyester polymer segment can be any of the variety of catalysts known in the art that are listed above in the item of the crystalline polyester resin. As for an esterification catalyst aid, examples thereof include gallic acid.

The content of the vinyl polymer segment of the hybrid vinyl resin is preferably within the range of 1 to 49 mass %, more preferably within the range of 5 to 20 mass % with respect to the binder resin.

Within this range, the releasing agent is suitably dispersed and incorporated, and the ratio of the polyester resin falls within a suitable range. Therefore, the fixability is improved.

Releasing Agent

Examples of releasing agents that can be used include hydrocarbon waxes such as polyethylene wax, polypropylene wax, polybutene wax and paraffin wax; silicones that exhibits a softening point when heated; fatty acid amides such as oleic acid amide, erucamide, ricinolic acid amide and stearic acid amide; vegetable waxes such as carnauba wax, rice wax, candelilla wax, wood wax and jojoba oil; animal waxes such as bee wax; ester waxes such as fatty acid esters and montanic acid esters; mineral/petroleum waxes such as montan wax, ozocerite, ceresin, microcrystalline wax and Fischer-Tropsch wax; modified products of thereof; and the like.

Among them, waxes with low melting point, specifically within the range of 60° C. to 85° C. are preferably used in terms of the releasability in low-temperature fixing. The percentage of the releasing agent in toner base particles is preferably within the range of 1 to 20 mass %, more preferably within the range of 5 to 15 mass %.

Coloring Agent

As a coloring agent of the toner, any of carbon blacks, magnetic materials, dyes and pigments and the like can be arbitrarily used. Carbon blacks that can be used include channel black, furnace black, acetylene black, thermal black, lamp black and the like. Magnetic materials that can be used include ferromagnetic metals such as iron, nickel and cobalt, alloys containing these metals, ferromagnetic metal compounds such as ferrite and magnetite, alloys that do not contain a ferromagnetic metal but acquire a ferromagnetic property by a heat treatment (e.g. so-called Hausler alloys such as manganese-copper-aluminum and manganese-copper-tin), chromium dioxide and the like.

Black coloring agents that can be used include, for example, carbon blacks such as furnace black, channel black, acetylene black, thermal black and lamp black, as well as magnetic powders of magnetite, ferrite and the like.

Examples of magenta or red coloring agents include C.I. pigment red 2, C.I. pigment red 3. C.I. pigment red 5. C.I. pigment red 6, C.I. pigment red 7, C.I. pigment red 15, C.I. pigment red 16. C.I. pigment red 48:1. C.I. pigment red 48:2. C.I. pigment red 48:3. C.I. pigment red 53:1. C.I. pigment red 57:1. C.I. pigment red 60, C.I. pigment red 63. C.I. pigment red 64. C.I. pigment red 68, C.I. pigment red 81, C.I. pigment red 81:1, C.I. pigment red 81:2, C.I. pigment red 81:4. C.I. pigment red 81:5, C.I. pigment red 83, C.I. pigment red 87, C.I. pigment red 88, C.I. pigment red 89, C.I. pigment red 90, C.I. pigment red 112. C.I. pigment red 114. C.I. pigment red 122, C.I. pigment red 123. C.I. pigment red 139, C.I. pigment red 144, C.I. pigment red 149, C.I. pigment red 150, C.I. pigment red 163, C.I. pigment red 166, C.I. pigment red 170, C.I. pigment red 177, C.I. pigment red 178, C.I. pigment red 184, C.I. pigment red 202. C.I. pigment red 206. C.I. pigment red 207, C.I. pigment red 209, C.I. pigment red 222, C.I. pigment red 238, C.I. pigment red 269 and the like.

Examples of orange or yellow coloring agents include C.I. pigment orange 31, C.I. pigment orange 43. C.I. pigment yellow 12, C.I. pigment yellow 14, C.I. pigment yellow 15, C.I. pigment yellow 17, C.I. pigment yellow 74, C.I. pigment yellow 83, C.I. pigment yellow 93. C.I. pigment yellow 94, C.I. pigment yellow 138, C.I. pigment yellow 155, C.I. pigment yellow 162, C.I. pigment yellow 180, C.I. pigment yellow 185 and the like.

Examples of green and cyan coloring agents include C.I. pigment blue 2, C.I. pigment blue 3. C.I. pigment blue 15, C.I. pigment blue 15:2, C.I. pigment blue 15:3. C.I. pigment blue 15:4, C.I. pigment blue 16, C.I. pigment blue 17, C.I. pigment blue 60, C.I. pigment blue 62, C.I. pigment blue 66, C.I. pigment green 7 and the like.

These coloring agents can be used alone or in combination of two or more according to need.

The amount of coloring agent added is preferably within the range of 1 to 30 mass %, more preferably within the range of 2 to 20 mass % with respect to the total amount of toner, in which a mixture of coloring agents can also be used. Within this range, the color reproducibility of an image is secured.

The size of the coloring agent is preferably within the range of 10 to 1000 nm, more preferably within the range of 50 to 500 nm, yet more preferably within the range of 80 to 300 nm in volume median size.

External Additive

The toner according to the present invention may contain particles of an external additive. External additive particles known in the art may be used. Examples of such external additive particles include inorganic oxide fine particles such as silica fine particles, alumina fine particles and titania fine particles; inorganic stearate compound fine particles such as aluminum stearate fine particles and zinc stearate fine particles; inorganic titanate compound fine particles such as strontium titanate and zinc titanate; and the like. They may be used alone or in combination of two or more. It is preferred that a gloss treatment with a silane coupling agent, a titanium coupling agent, a higher fatty acid or a silicone oil is given to these inorganic fine particles in order to improve the thermal storage stability and the environmental stability.

Organic fine particles may also be used as external additive particles. Organic fine particles that can be used are spherical organic particles having a number average primary particle size of approximately from 10 to 2000 nm. Specifically, organic fine particles of homopolymers such as styrene and methylmethacylate and copolymers thereof can be used.

Lubricants may also be used as an external additive. Lubricants are used for the purpose of improving the cleaning property and the transferring property. Specific examples thereof include metal salts of higher fatty acids such as stearates of zinc, aluminum, copper, magnesium, calcium and the like, oleates of zinc, manganese, iron, copper, magnesium and the like, palmitates of zinc, copper, magnesium, calcium and the like, linoleates of zinc, calcium and the like, ricinoleates of zinc, calcium and the like, and the like.

These external additives may be used in a variety of combinations.

The amount of external additive added is preferably within the range of 0.1 to 10.0 parts by mass with respect to 100 parts by mass of the toner particles. The external additive may be added by using any of a variety of mixing machines known in the art such as a turbuler mixer, a HENSCHEL MIXER, a nauta mixer or a V-shaped mixer.

Glass Transition Point of Toner

The glass transition point of the toner of the present invention is preferably within the range of 25° C. to 65° C., more preferably within the range of 35° C. to 60° C. When the glass transition point of the toner of the present invention falls within this range, the sufficient low-temperature fixability and the sufficient thermal storage stability of the toner can be achieved.

Glass transition point (Tg) can be measured by differential scanning calorimetry (DSC). Specifically, it is measured with a "DIAMOND DSC" (PerkinElmer Co., Ltd.).

The procedure and conditions of the measurement are the same as those for measuring the above-described melting point. The data in the second heating step is analyzed, and the glass transition point is defined as the intersection between an extension of the baseline of the part before the rise of the first endothermic peak and the tangent with the maximum slope in the part from the rise of the first endothermic peak to the peak top.

Particle Size and Coefficient of Variation of Number Particle Size Distribution of Toner The average particle size of the toner of the present invention is preferably within the range of 3 to 8 μm, more preferably within the range of 5 to 8 m in volume median size. The average particle size is controllable by changing the concentration of a coagulant used and the amount of organic solvent added in the production, the fusing time, the composition of the binder resin and the like. When the volume median size falls within this range, it is possible to faithfully reproduce a very fine dot image at a level of 1200 dpi.

The volume median size of the toner particles is measured and calculated with a measuring device "MULTISIZER-3" (Beckman Coulter Corp.) connected to a computer system with a data processing software "SOFTWARE V3.51".

Specifically, 20 mL of surfactant solution (for the purpose of dispersing toner particles. e.g. neutral detergent containing a surfactant component, diluted by 10 times with pure water) is added to 0.02 g of toner particles and mixed.

Thereafter, the solution is subjected to ultrasonic dispersion for 1 minute so that toner particle dispersion is prepared. By using a pipette, the toner particle dispersion is added to "ISOTON II" (Beckman Coulter Corp.) in a beaker set in a sample stand until the concentration displayed on the measuring device reaches 8%. At this concentration, it is possible to obtain a reproducible measurement value.

The particle count and the aperture diameter of the measuring device are respectively set to 25000 and 50 μm. The measurement range of 1 to 30 μm is divided into 256 sections, and the frequency values of the respective sections are calculated. The volume median size is defined as the particle size where the percentage of cumulative volume of the larger particles reaches 50%. Further, the number-based particle size distribution is calculated similarly, and the coefficient of variation thereof is determined, which is referred to as a CV value.

The external additive that is liberated from the toner particles is excluded from the measurement result and the calculation.

It is preferred that the coefficient of variation (CV value) of the number particle size distribution of the toner particles is equal to or less than 20%. Within this range, toner particles can be prevented from tumbling or being scattered in a nip in a toner transferring step or a fixing step. Therefore, the dot reproducibility can be improved, and the image quality can be improved accordingly.

Average Circularity of Toner Particles

In the toner of the present invention, it is preferred that the average circularity of the toner particles of the toner is within the range of 0.920 to 1.000, more preferably within the range of 0.940 to 0.995 in terms of the stability of the charge characteristic and the low-temperature fixability.

When the average circularity falls within this range, the individual toner particles are less crushable. This prevents the triboelectric charging member from smudges and stabilizes the charge characteristic of the toners. Further, high quality images can be formed.

The average circularity of the toner particles is measured with an "FPIA-3000" (Sysmex Corp.). Specifically, a measurement sample (toner particles) is mixed with an aqueous solution containing a surfactant and is further subjected to ultrasonic dispersion for 1 minute. Thereafter, photographs are taken with the "FPIA-3000" (Sysmex Corp.) in the measurement conditions of the HPF (high power photographing) mode at an adequate concentration corresponding to a number of HPF detection of 3000 to 10000. The average circularity of the toner is calculated by determining the circularity of individual toner particles according to the following Equation and dividing the sum of circularities of the individual toners by the total number of toner particles. When the number of HPF detection is within this range, the result is reproducible.

Circularity=(Circumference of circle having same area as projected image of particle)/(Perimeter of projected image of particle)

The external additive that is liberated from the surface of the toner particles may sometimes be counted. In this case, it is excluded from the measurement and the calculation.

Method of Producing Toner

The method of producing the toner of the present invention is not particularly limited, and examples of methods include methods known in the art such as a kneading and grinding method, a suspension polymerization method, an emulsion aggregation method, a dissolution and suspension method, a polyester elongation method, a dispersion polymerization method.

Among them, an emulsion aggregation method is preferably used in terms of ensuring the dispersion of the releasing agent, the uniformity of the particle size and the controllability of the shape.

Emulsion Aggregation Method

An emulsion aggregation method is a method of producing toner particles that involves mixing dispersion of resin fine particles (hereinafter referred to as "resin particles") dispersed with the aid of a surfactant or a dispersion stabilizer, with dispersion of toner particle components such as coloring agent fine particles; adding a coagulant to allow the components to aggregate to a desired particle size of toner, and thereafter or simultaneously with the aggregation, fusing the resin particles with each other to control the shape.

The resin particles can be produced by emulsion polymerization, mini-emulsion polymerization or phase emulsification, or a combination of two or more methods.

To incorporate an internal additive into toner particles, the internal additive may be incorporated into the resin particles. Alternatively, dispersion containing only internal additive particles may be separately prepared, and the internal additive particles may be aggregated simultaneously with the aggregation of the resin particles.

The toner that is produced by an emulsion aggregation method may have a core-shell structure. An example of a method of producing the core-shell toner will be described. First, core particles are prepared by aggregating and fusing binder resin particles for core particles and an optional coloring agent according to need. Then, the shells are formed by adding binder resin particles for shells to the dispersion of the core particles and aggregating and fusing the binder resin particles for shells on the surface of the core particles.

When the toner is produced by an emulsion aggregation method, a preferred embodiment of the method of producing the toner involves the steps of: (a) preparing crystalline polyester resin particle dispersion, amorphous polyester resin particle dispersion, hybrid vinyl resin particle dispersion and releasing agent particle dispersion (hereinafter also referred to as a preparing step): and (b) mixing the crystalline polyester resin particle dispersion, the amorphous polyester resin particle dispersion, the hybrid vinyl resin particle dispersion and the releasing agent particle dispersion to cause aggregation and fusion (hereinafter also referred to as aggregating and fusing step).

Hereinafter, the steps (a) and (b) and the other optional steps (c) to (e) will be described in detail.

(a) Preparing Step

The preparing step (a) involves a crystalline polyester resin particle dispersion preparing step, an amorphous polyester resin particle dispersion preparing step and a hybrid vinyl resin particle dispersion preparing step. According to need, the preparing step (a) further involves a coloring agent particle dispersion preparing step, a releasing agent particle dispersion preparing step and the like.

(a-1) Crystalline Polyester Resin Particle Dispersion Preparing Step

The crystalline polyester resin particle dispersion preparing step is to synthesize the crystalline polyester resin of the toner particles and to disperse the crystalline polyester resin in an aqueous medium in the form of fine particles, so as to prepare dispersion of the crystalline polyester resin particles.

The method of producing the crystalline polyester resin is as described above, and the description is omitted.

An example of the method of preparing the crystalline polyester resin particle dispersion involves dispersing the particles in an aqueous medium without using any solvent. Another example of the method involves dissolving the crystalline polyester resin into solvent such as ethyl acetate, emulsifying and dispersing the solution in an aqueous medium with a disperser and removing the solvent.

In the present invention, the term "aqueous medium" refers to a medium that contains water in the amount of at least 50 mass %. The remaining components other than water can be organic solvents that are soluble in water. Examples of such organic solvents include methanol, ethanol, isopropanol, butanol, acetone, methylethylketone, dimethylformamide, methylcellosolve, tetrahydrofuran and the like. Among them, alcohol organic solvents that do not dissolve the resin, such as methanol, ethanol, isopropanol and butanol, are preferably used. It is preferred that only water is used as the aqueous medium.

The crystalline polyester resin may have a carboxy group in the structure. In this case, ammonia, sodium hydroxide or the like may be added so that the carboxy group in the unit is ionically dissociated. This stabilizes the emulsion in the aqueous phase and facilitates the emulsification process.

A dispersion stabilizer may be dissolved in the aqueous medium. Further, a surfactant, resin particles or the like may be added for the purpose of improving the dispersion stability of oil particles.

Dispersion stabilizers known in the art can be used. For example, dispersion stabilizers that are soluble in acids or alkalis such as tricalcium phosphate are preferably used. In terms of environmental issues, enzymatically degradable dispersion stabilizers are preferably used.

Examples of surfactants that can be used include anionic surfactants, cationic surfactants, nonionic surfactants and ampholytic surfactants known in the art.

Examples of resin particles for improving the dispersion stability include polymethyl methacrylate resin particles, polystyrene resin particles, polystyrene-acrylonitrile resin particles and the like.

The above-described dispersing process can be performed by means of mechanical energy. The disperser is not particularly limited, and examples of dispersers include homogenizers, low-speed shearing dispersers, high-speed shearing dispersers, friction dispersers, high-pressure jet dispersers, ultrasonic dispersers, high-pressure impact dispersers (Altimizer), emulsion dispersers and the like.

It is preferred to heat the solution during the dispersing process. The heating condition is not particularly limited, but a typical temperature is approximately from 60° C. to 100° C.

The particle size of crystalline polyester resin particles (oil particles) in the crystalline polyester resin particle dispersion thus prepared is preferably within the range of 60 to 1000 nm, more preferably within the range of 80 to 500 nm in volume median size.

Volume median size can be measured by dynamic light scattering with a "MICROTRAC UPA-150 (Nikkiso Co., Ltd.).

The volume median size of the oil particles is controllable by changing the degree of neutralization and the mechanical energy applied in the emulsion dispersing.

The dispersion size of the oil particles is controllable by changing the mechanical energy applied in the emulsion dispersing and the like, which can be measured by the method described in the section of examples.

The content of the crystalline polyester resin particles in the crystalline polyester resin particle dispersion is preferably within the range of 10 to 50 mass %, more preferably within the range of 15 to 40 mass % with respect to 100 mass % of the whole dispersion. Within this range, the deviation of the particle size distribution can be narrowed, and the toner properties can be improved.

(a-2) Amorphous Polyester Resin Particle Dispersion Preparing Step

The amorphous polyester resin particle dispersion preparing step is to synthesize the amorphous resin of the toner particles and to disperse the amorphous polyester resin in an aqueous medium in the form of fine particles, so as to prepare dispersion of the amorphous polyester resin particles.

The method of producing the amorphous polyester resin is as described above, and the description is omitted. The method of preparing the dispersion is the same as the method described in the above (a-1) crystalline polyester resin particle dispersion preparing step, and the description is omitted.

The particle size of the amorphous polyester resin particles in the amorphous polyester resin particle dispersion is preferably within the range of 30 to 500 nm in volume median size for example. The particle size of the amorphous polyester resin particles can be measured, for example, by dynamic light scattering with a "MICROTRAC UPA-150" (Nikkiso Co., Ltd.). The dispersion size of the oil particles of the amorphous polyester resin particles is controllable by changing the mechanical energy applied in the emulsion dispersing or the like.

(a-3) Hybrid Vinyl Resin Particle Dispersion Preparing Step

The hybrid vinyl resin particle dispersion preparing step is to synthesize the hybrid vinyl resin of the toner particles and to disperse the hybrid vinyl resin in an aqueous medium in the form of fine particles, so as to prepare dispersion of the hybrid vinyl resin particles.

The method of producing the hybrid vinyl resin is as described above, and the description is omitted. The method of preparing the hybrid vinyl resin particle dispersion is the same as the method described in the above (a-1) crystalline polyester resin particle dispersion preparing step, and the description is omitted.

The particle size of the hybrid vinyl resin particles in the hybrid vinyl resin particle dispersion is preferably within the range of 30 to 500 nm in volume median size for example. The particle size of the hybrid vinyl resin particles can be measured, for example, by dynamic light scattering with a "MICROTRAC UPA-150" (Nikkiso Co., Ltd.). The dispersion size of the oil particles of the hybrid vinyl resin particles is controllable by changing the mechanical energy applied in the emulsion dispersing or the like.

(a-4) Coloring Agent Particle Dispersion Preparing Step/ Releasing Agent Particle Dispersion Preparing Step The coloring agent particle dispersion preparing step is to disperse the coloring agent in an aqueous medium in the form of fine particles so as to prepare dispersion of the coloring agent particles.

The releasing agent particle dispersion preparing step is to disperse the releasing agent in an aqueous medium in the form of fine particles so as to prepare dispersion of releasing agent particles.

The aqueous medium is the same as described in the above (a-1). A surfactant or resin particles may be added to the aqueous medium for the purpose of improving the dispersion stability.

The coloring agent and the releasing agent can be dispersed by means of mechanical energy. The disperser for this purpose is not particularly limited, and the dispersers listed in the above (a-1) can be used.

The content of the coloring agent in the coloring agent particle dispersion is preferably within the range of 10 to 50 mass %, more preferably within the range of 15 to 40 mass %. Within this range, an advantageous effect of securing the color reproducibility is obtained.

The content of the releasing agent in the releasing agent particle dispersion is preferably within the range of 10 to 50 mass %, more preferably within the range of 15 to 40 mass %. Within this range, advantageous effects of preventing an offset and securing the releasing property are obtained.

The dispersion size of the coloring agent particles in the coloring agent particle dispersion is preferably within the range of 10 to 300 nm in volume median size. The dispersion size of the coloring agent particles in the coloring agent particle dispersion can be measured, for example, by dynamic light scattering with a "MICROTRAC UPA-150" (Nikkiso Co., Ltd.).

The dispersion size of the releasing agent particles in the releasing agent particle dispersion is preferably within the range of 10 to 300 nm in volume median size. The dispersion size of the releasing agent particles in the releasing agent particle dispersion can be measured, for example, by dynamic light scattering with a "MICROTRAC UPA-150" (Nikkiso Co., Ltd.).

(b) Aggregating and Fusing Step

The aggregating and fusing step is to cause aggregation of the crystalline polyester resin particles, the amorphous polyester resin particles, the hybrid vinyl resin particles, the releasing agent particles and the optional coloring agent particles according to need in an aqueous medium and to fuse these particles with each other simultaneously with the aggregation.

In this step, the crystalline polyester resin particles, the amorphous polyester resin particles, the hybrid vinyl resin particles, the releasing agent particles and the optional coloring agent particles according to need are mixed and dispersed in an aqueous medium.

Then, after an alkali metal salt, a salt containing a Group-II element or the like is added as a coagulant, the dispersion is heated at a temperature that is equal to or greater than the glass transition point of the crystalline polyester resin particles, the amorphous polyester resin particles and the hybrid vinyl resin particles to proceed the aggregation and to fuse the resin particles with each other at the same time.

Specifically, the toner is formed by mixing the crystalline polyester resin particle dispersion, the amorphous polyester resin particle dispersion, the releasing agent particle dispersion and the optional coloring agent particle dispersion according to need which are prepared in the previous step, and adding a coagulant such as magnesium chloride thereto to cause aggregation of the crystalline polyester resin particles, the amorphous polyester resin particles, the hybrid vinyl resin particles and the releasing agent particles and the optional coloring agent particles while fusing these particles with each other at the same time.

The coagulant used in this step is not particularly limited but is preferably selected from metal salts.

Examples of such metal salts include salts of monovalent metals such as alkali metals including sodium, potassium and lithium, salts of divalent metals such as calcium, magnesium, manganese and copper, salts of trivalent metals such as iron and aluminum, and the like Specific examples of such salts include sodium chloride, potassium chloride, lithium chloride, calcium chloride, magnesium chloride, zinc chloride, copper sulfate, magnesium sulfate, manganese sulfate and the like. Among them, salts of divalent metals are particularly preferred. These divalent metal salts can cause aggregation in a smaller amount. These coagulants can be used alone or in combination of two or more.

In the aggregating step, it is preferred that the waiting time after the addition of the coagulant (before heating) is as short as possible. That is, it is preferred to start heating the dispersion for the aggregation to a temperature equal to or greater than the glass transition point of the crystalline polyester resin and the amorphous polyester resin as soon as possible after the addition of the coagulant.

The reason has not been clearly revealed yet, but it is assumed that the aggregated state of the particles changes over time during the waiting time, and which increases the variation of the particle size distribution and changes the surface properties of the toner particles to be obtained.

The waiting time is typically within 30 minutes, preferably within 10 minutes. The temperature at which the coagulant is added is not particularly limited, but is preferably equal to or less than the glass transition point of the crystalline polyester resin, the amorphous polyester resin and the hybrid vinyl resin contained in the toner particles.

In the aggregating step, it is preferred that the temperature of dispersion is raised rapidly by heating after the coagulant is added. The heating rate is preferably equal to or less than 0.8° C./min. The upper limit of the heating rate is not particularly limited but is preferably equal to or less than 15° C./min in terms of preventing the occurrence of bulk particles due to the rapid fusion. After the dispersion for aggregation reaches a desired temperature, it is important to maintain the temperature of the dispersion for aggregation for a certain time to continue the fusion, preferably until the volume median size falls within the range of 4.5 to 7.0 μm.

(c) Cooling Step

The cooling step is to cool the dispersion of the toner particles. The cooling rate in the cooling step is not particularly limited but is preferably within the range of 0.2 to 20° C./min. The cooling method is not particularly limited. For example, the dispersion can be cooled by circulating a coolant from the outside of the reaction vessel, or by adding cold water directly to the reaction system.

(d) Filtrating, Washing and Drying Step

In the filtering step, toner base particles are filtered from the dispersion of the toner particles. The filtration method is not particularly limited, and examples of methods include centrifugation, reduced pressure filtration with a Nutsche, filtration with a filter press or the like.

Then, in the washing step, the filtered toner base particles (aggregated cake) are washed so that adhered materials such as the surfactant and the coagulant are removed. In the washing step, the particles are washed with water until the electrical conductivity of the filtrate reaches a level of 5 to 10 ρS/cm.

In the drying step, the washed toner base particles are subjected to a drying process. Dryers that can be used in the drying step include dyers known in the art such as spray dryers, flash jet dryers, vacuum freeze divers and reduced pressure dryers. Further, fixed rack dryers, movable rack dryers, fluidized-bed dryers, rolling dryers and stirring dryers can also be used. The water content of the dried toner base particles is preferably equal to or less than 5 mass %, more preferably equal to or less than 2 mass %.

When the dried toner base particles are aggregated by weak interparticle force, they may be subjected to a cracking process. Cracking machines that can be used for this purpose include mechanical cracking machines such as jet mills, HENSCHEL MIXERS, coffee mills and food processors.

(e) External Additive Treatment Step

The external additive treatment step is to add and mix the external additive to the surface of the dried toner base particles so that the toner is produced. Addition of the external additive can improve the fluidity and the charge characteristic of the toner and improve the cleaning property of the toner.

Electrostatic Latent Image Developer

The toner of the present invention may be used as a magnetic or nonmagnetic one-component developer or as a two-component developer by being mixed with a carrier. When used as a two-component developer, examples of carriers that can be used include magnetic particles known in the art that are made of metals such as iron, ferrite and magnetite, alloys of these metals with another metal such as aluminum and lead, and the like. Among them, ferrite particles are preferably used.

Further, carriers that can also be used include coated carriers, in which the surface of magnetic particles is covered with a coating agent such as a resin, and dispersed carriers, in which magnetic fine powder is dispersed in a binder resin.

It is preferred that the volume median size of the carrier is preferably within the range of 15 μm to 100 μm, more preferably within the range of 25 m to 60 μm. The volume median size of the carrier can be measured typically with a laser diffraction particle size measuring device "HELOS" (Sympatecs GmbH) equipped with a wet disperser.

Image Forming Method

The electrostatic latent image developing toner and the electrostatic latent image developer using the toner of the present invention can be used for a variety of electrophotographic image forming methods known in the art such as black and white image forming methods and full-color image forming methods.

Such full-color image forming methods can be any image forming methods including four-cycle image forming methods using four color developers respectively for yellow, magenta, cyan and black and a single electrostatic latent image carrier (also referred to as an "electrophotographic photoreceptor" or simply a "photoreceptor") and tandem image forming methods using image forming units for respective colors each including a color developer and an electrostatic latent image carrier.

Preferred image forming methods involve a fixing step by heat-pressure fixing in which the toner can be heated while a pressure is applied.

Specifically, such image forming methods involves using the toner of the present invention to develop an electrostatic latent image formed on a photoreceptor so as to obtain a toner image, transferring the toner image to an image support, and thereafter fixing the toner image on the image support by a heat-pressure fixing process. Printed matter on which a visible image is formed is thus obtained.

In the fixing step, it is preferred that a pressure is applied simultaneously with heating. However, a pressure may be applied first, and thereafter the toner may be heated.

In the image forming methods using the toner of the present invention, a variety of fixing devices known in the art can be used for heat-pressure fixing.

EXAMPLES

Hereinafter, examples are described to specifically illustrate the present invention. However, the present invention is not limited thereto. In the examples, the terms "part(s)" and "%" indicate respectively "part(s) by mass" and "mass %" unless otherwise noted.

Production of Electrostatic Latent Image Developing Toner and Developer

Preparation of Coloring Agent Dispersion

Cyan pigment (C.I. pigment blue 15:3): 200 parts by mass

Anionic surfactant (NEOGEN SC, DKS Co., Ltd): 33 parts by mass (60% effective component, i.e. 10 mass % with respect to the coloring agent)

Ion-exchanged water 750 parts by mass

To a stainless steel vessel with such a capacity that the liquid level reaches approximately ⅓ of the vessel height when all of the above components are charged, a part (280 parts by mass) of the ion-exchanged water and the anionic surfactant were charged. The mixture was heated to 40° C., and after the surfactant is sufficiently dissolved, the mixture was cooled to 25° C. All of the pigment was added, and the mixture was stirred until no dry pigment is observed. Then, the mixture was sufficiently degassed.

After degassing, the remainder of the ion-exchanged water was added, and the mixture was dispersed with a homogenizer (ULTRA-TURRAX T50, IKA Corp.) at 5000 rotations for 10 minutes and thereafter stirred with a stirrer for one day. After degassing, the mixture was dispersed again with the homogenizer at 6000 rotations for 10 minutes and thereafter stirred with a stirrer for one day and degassed. Subsequently, the dispersion was further dispersed with high-pressure impact disperser (ALTIMIZER HJP30006, Sugino Machine Ltd.) at a pressure of 240 MPa. The dispersion was continued for 25 passes equivalent, which was calculated from the total amount of material charged and the capacity of the device.

The dispersion was left for 72 hours, the precipitate was removed, and the solid concentration was adjusted to 15 mass % the by adding ion-exchanged water. The volume average particle size D50v of the particles in the coloring agent dispersion thus obtained was 165 nm, and no bulk particles with a size of 250 nm or more were observed. The volume average particle size D50v was an average of three measurement values of five measurements with a MICROTRAC excluding the largest and the smallest values.

Preparation of Releasing Agent Dispersion

Preparation of Releasing Agent Dispersion DW1

Hydrocarbon wax (product name: FNP0090, Nippon Seiro Co., Ltd., melting temperature Tw=90.2° C.): 270 parts by mass Anionic surfactant (NEOGEN RK, DKS Co., Ltd., 60 mass % effective component): 13.5 parts by mass (3.0 mass % as the effective component with respect to the releasing agent)

Ion-exchanged water: 21.6 parts by mass

The above components were mixed, and the releasing agent was dissolved at an inner liquid temperature of 120° C. and thereafter dispersed at a dispersion pressure of 5 MPa for 120 minutes and then at a dispersion pressure of 40 MPa for 360 minutes with a pressure jetting homogenizer (GAULIN HOMOGENIZER, Gaulin Corp.). The dispersion was cooled so that releasing agent dispersion DW1 was obtained. The volume average particle size D50v of the particles in the releasing agent dispersion was 225 nm. Thereafter, the solid concentration was adjusted to 20.0 mass % by adding ion-exchanged water.

Preparation of Releasing Agent Dispersion DW2, DW3

Releasing agent dispersions DW2, DW3 were prepared in the same manner as the releasing agent dispersion DW1 except that the hydrocarbon wax of the releasing agent dispersion DW1 was changed to an ester wax (product name: WEP-6, NOF Corp., melting temperature Tw=77.0° C.) in the releasing agent dispersion DW2 and to an amide wax (product name: ALFLO E10, NOF Corp., melting temperature Tw=74° C.) in the releasing agent dispersion DW3. The volume average particle size D50v of the particles in the dispersions were respectively 230 nm and 245 nm.

Preparation of Amorphous Polyester Resin

Preparation of Amorphous Polyester Resin A1

Into a reaction vessel equipped with a stirrer, a thermometer, a condenser and a nitrogen gas introducing tube, the monomer components in Table 1 (terephthalic acid, fumaric acid, dodecenyl succinic anhydride and trimellitic acid) except for the fumaric acid and the trimellitic anhydride, and dibutyltin oxide were charged in the proportion shown in Table 1.

Under a nitrogen gas flow, reaction was continued at 235° C. for 6 hours. The mixture was cooled to 200° C. the fumaric acid and the trimellitic anhydride were added, and the reaction was further continued for 1 hour. The temperature was raised to 220° C. over 4 hours, and polymerization was continued at a pressure of 10 kPa until the molecular weight reaches a predetermined value. A translucent pale yellow product of amorphous polyester resin A1 was obtained. The main peak of the molecular weight was at 13000.

Preparation of Amorphous Polyester Resin A2

Into a reaction vessel equipped with a stirrer, a thermometer, a condenser and a nitrogen gas introducing tube, the monomer components in Table 1 except for the fumaric acid, and dibutyltin oxide were charged in the proportion shown in Table 1.

Under a nitrogen gas flow, reaction was continued at 235° C. for 6 hours. The mixture was cooled to 200° C., the fumaric acid were added, and the reaction was further continued for 1 hour. The temperature was raised to 220° C. over 4 hours, and polymerization was continued at a pressure of 10 kPa until the molecular weight reaches a predetermined value. A translucent pale yellow product of amorphous polyester resin A2 was obtained. The main peak of the molecular weight was at 10000.

Preparation of Amorphous Polyester Resin A3

Into a reaction vessel equipped with a stirrer, a thermometer, a condenser and a nitrogen gas introducing tube, the monomer components of the resin A1 in Table 1 except for the fumaric acid and the trimellitic anhydride, and dibutyltin oxide were charged in the proportion shown in Table 1.

Under a nitrogen gas flow, reaction was continued at 235° C. for 6 hours. The mixture was cooled to 200° C., the fumaric acid and the trimellitic anhydride were added, and the reaction was further continued for 1 hour. The temperature was raised to 220° C. over 4 hours, and polymerization was continued at a pressure of 10 kPa until the molecular weight reaches a predetermined value. A translucent pale yellow product of amorphous polyester resin A3 was obtained. The main peak of the molecular weight was at 30000.

Preparation of Amorphous Polyester Resin A4

Into a reaction vessel equipped with a stirrer, a thermometer, a condenser and a nitrogen gas introducing tube, the monomer components of A2 in Table 1 except for the fumaric acid, and 0.05 parts by mass of dibutyltin oxide were charged in the amounts shown in Table 1.

Under a nitrogen gas flow, reaction was continued at 235° C. for 6 hours. The mixture was cooled to 200° C., the fumaric acid was added, and the reaction was further continued for 1 hour. The temperature was raised to 220° C. over 4 hours, and polymerization was continued at a pressure of 10 kPa until the molecular weight reaches a predetermined value. A translucent pale yellow product of amorphous polyester resin A4 was obtained. The main peak of the molecular weight was at 8000.

Preparation of Amorphous Polyester Resin A5

Amorphous polyester resin A5 was prepared in the same manner as the amorphous polyester resin A1 except that the monomer composition was changed as listed in Table 1. The main peak of the molecular weight was at 40000.

Preparation of Hybrid Vinyl Resin

Preparation of Hybrid Vinyl Resin B1

The monomer materials of a vinyl resin component (styrene, butyl acrylate, acrylic acid, 2-octyl acrylate, 2-hexyl acrylate, isostearyl acrylate, 2-behenyl acrylate, 2-ethylhexyl acrylate and ethyl acrylate) shown in Table 2, 35 parts by mass of a polymerization initiator (di-t-butylperoxide), and alcohol monomer materials of a polycondensation resin component (polyalcohol monomer: bisphenol A ethylene oxide and bisphenol A propylene oxide) were charged into a 10-L four-neck flask equipped with a nitrogen introduction tube, a dewatering tube, a stirrer and a thermocouple. Thereafter, acid monomer materials of the polycondensation resin component (polycarboxylic acid monomer: terephthalic acid, fumaric acid and dodecenyl succinic anhydride) were added.

Dibutyltin oxide was added as a catalyst, the temperature was raised to 175° C. the reaction was continued for 10 hours, and then the temperature was further raised to 200° C. over 10 hours. Then, after the temperature was decreased to 180° C., the reaction was continued until the acid value reaches approximately 24 mgKOH/g. The hybrid vinyl resin B1 having a main chain of a vinyl polymer segment and a side chain of a polyester polymer segment was thus produced.

Preparation of Hybrid Vinyl Resins B2 to B8, B13

Hybrid vinyl resins B2 to B8 and B13 were prepared in the same manner as the hybrid vinyl resin B1 except that the materials listed in Table 2 were used.

Preparation of Hybrid Vinyl Resin B9

The monomer materials of a vinyl resin component shown in Table 2 and 35 parts by mass of a polymerization initiator (di-t-butylperoxide) were charged into a 10-L four-neck flask equipped with a nitrogen introduction tube, a dewatering tube, a stirrer and a thermocouple. Thereafter, the temperature was raised to 175° C., and the reaction was continued for 10 hours so that an amorphous vinyl resin was produced. Methyl ethyl ketone (500 parts by mass) was added thereto, and the reaction was continued at 60° C. for 1 hour. Hexamethylene diisocyanate (36 parts by mass) was added to the solution, and the reaction was continued at 80° C. for 10 hours. Thereafter, the methyl ethyl ketone was distilled away so that the urethane-modified hybrid vinyl resin B9 was synthesized.

Preparation of Hybrid Vinyl Resin B10

Hybrid vinyl resin B10 was prepared from the same monomers as those of the hybrid vinyl resin B1 according to the following procedure.

Into a 10-L four-neck flask equipped with a nitrogen introduction tube, a dewatering tube, a stirrer and a thermocouple, the alcohol monomer materials (polyalcohol monomers) of the polycondensation resin component, the acid monomer materials (polycarboxylic acid monomers) of the polycondensation resin component and acrylic acid were charged. Dibutyltin oxide was added as a catalyst, and the temperature was raised to 200° C. over 10 hours.

Then, the temperature was decreased to 180° C. and the monomer materials of the vinyl resin component except for acrylic acid and 35 parts by mass of the polymerization initiator (di-t-butylperoxide) were added to cause a reaction. The hybrid vinyl resin B10 having a main chain of a polyester polymer segment and a side chain of a vinyl polymer segment was thus produced.

Preparation of Hybrid Vinyl Resin B11

Hybrid vinyl resin B11 was prepared from the same monomers as those of the hybrid vinyl resin B1 according to the following process.

Into a 10-L four-neck flask equipped with a nitrogen introduction tube, a dewatering tube, a stirrer and a thermocouple, the alcohol monomer materials (polyalcohol monomers) of the polycondensation resin component, the acid monomer materials (polycarboxylic acid monomers) of the polycondensation resin component were charged. Dibutyltin oxide was added as a catalyst, and the temperature was raised to 200° C. over 10 hours.

Then, the temperature was decreased to 180° C., and the monomer materials of the vinyl resin component and 35 parts by mass of the polymerization initiator (di-t-butylperoxide) were added to cause a reaction. The hybrid vinyl resin B11 having a main chain of a vinyl polymer segment and a terminal of a polyester polymer segment was thus produced.

Preparation of Hybrid Vinyl Resin B12

The monomer materials of a vinyl resin component shown in Table 2 and 35 parts by mass of a polymerization initiator (di-t-butylperoxide) were charged into a 10-L four-neck flask equipped with a nitrogen introduction tube, a dewatering tube, a stirrer and a thermocouple. Thereafter, the temperature was raised to 175° C., and the reaction was continued for 10 hours, so that amorphous vinyl resin B12 was produced. Although the resin B12 is not a hybrid vinyl resin but an amorphous vinyl resin, it is listed on the column of hybrid vinyl resins for descriptive reasons.

Preparation of Crystalline Polyester Resin C1

Into a reaction vessel equipped with a stirrer, a thermometer, a condenser and a nitrogen gas introduction tube, 1,10-dodecanedioic acid and 1,9-nonanediol (monomer components) as shown in Table 3 were charged. After the reaction vessel is purged with dry nitrogen gas, dibutyltin oxide was added in the amount listed in Table 3. Under a nitrogen gas flow, a reaction was continued at 170° C. for 3 hours. Thereafter, the temperature was further raised to 210° C. over 1 hour, the pressure in the reaction vessel was reduced to 3 kPa, and the reaction was continued for 13 hours while stirring so that crystalline polyester resin C1 was obtained.

The crystalline polyester resin C1 thus obtained had a main peak of the molecular weight at 8100, and the volume average particle size of the particles in the resin particle dispersion was 165 nm.

Preparation of Amorphous Polyester Resin Particle Dispersions DA1 to DA5

Into a 3-L reaction tank with a jacket (BJ-30N, Tokyo Rikakikai Co., Ltd.) which is equipped with a condenser, a thermometer, a water dripper and an anchor fin and is maintained at 40° C. in a water circulating thermostat bath, mixed solvent composed of 160 parts by mass of ethyl acetate and 100 parts by mass of isopropyl alcohol was charged.

To the solvent, 300 parts by mass of the above-described amorphous polyester resin A1 was added, and the mixture was stirred with a THREE-ONE motor at 150 rpm to dissolve the resin so that an oil phase was obtained.

To the stirred oil phase, 14 parts by mass of 10 mass % ammonia solution was added dropwise over 5 minutes. After the mixture was stirred for 10 minutes, 900 parts by mass of ion-exchanged water was further added dropwise at a rate of 7 parts by mass per minute to cause phase inversion so that emulsion was obtained.

Immediately, 800 parts by mass of the emulsion thus obtained and 700 parts by mass of ion-exchanged water were charged into a 2-L eggplant flask, and the flask was set to an evaporator equipped with a vacuum control unit (Tokyo Rikakikai Co., Ltd) via a ball trap.

While being rotated, the eggplant flask was heated in a water bath at 60° C. The pressure was reduced to 7 kPa with careful attention in order to avoid bumping, so that the solvent was removed.

The pressure was increased to ordinary pressure when the amount of solvent collected reached 1100 parts by mass, and the eggplant flask was cooled by water so that the dispersion was obtained. The dispersion thus obtained did not have solvent odor. The volume average particle size D50v of the resin particles of the dispersion was 130 nm.

Thereafter, the solid concentration was adjusted to 20 mass % by adding ion-exchanged water. The amorphous polyester resin particle dispersion DA1 was thus obtained.

Amorphous polyester resin particle dispersions DA2 to DA5 were prepared in the same manner except that the amorphous polyester resins A2 to A5 were used instead of the amorphous polyester resin A1. The volume average particle size D50v of the resin particles in the dispersions was approximately 150 nm.

Preparation of Hybrid Vinyl Resin Particle Dispersion

Preparation of Hybrid Vinyl Resin Particle Dispersion DB1

The hybrid vinyl resin B1 (300 parts by mass) was melted, and the resin was transferred to an emulsification disperser "CAVITRON CD1010" (Eurotec, Ltd.) in the molten state at a transfer rate of 100 parts by mass per minute. Simultaneously with the transfer of the molten hybrid vinyl resin B1, 0.37 mass % diluted aqueous ammonia, which was prepared by diluting aqueous ammonia regent with ion-exchanged water in an aqueous medium tank, was transferred to the emulsification disperser at a transfer rate of 0.1 L/min while the diluted aqueous ammonia was being heated at 100° C. with a heat exchanger.

Then, the emulsification disperser is operated in the conditions of a rotation speed of the rotator of 60 Hz and a pressure of 5 kg/cm$^2$ so that hybrid vinyl resin particle dispersion DB1 was prepared. The diluted aqueous ammonia was added so that the degree of neutralization reaches 45%. The dispersion size of the hybrid vinyl resin particles in the hybrid vinyl resin particle dispersion DB1 was 225 nm in volume median size.

Preparation of Hybrid Vinyl Resin Particle Dispersions DB2 to DB13

Hybrid vinyl resin particle dispersions DB2 to DB13 were prepared in the same manner except that the hybrid vinyl resin B1 was changed to the hybrid vinyl resins B2 to B13. The detailed composition of the hybrid vinyl resin particle dispersions is shown in Table 4. In the column "structure" of Table 4, "A" represents graft, "B" represents a polyester (PES) main chain and a vinyl side chain, and "C" represents a modified terminal.

The procedure of preparing hybrid vinyl resin B14 is not described here since the resin and the dispersion DB 14 thereof were prepared in a continuous process. Instead, the procedure of preparing the hybrid vinyl resin particle dispersion DB14 will be described later.

Although DB12 and DB14 are resin particle dispersions composed of only the respective vinyl polymer segments B12 and B14, they are described as hybrid vinyl resin particle dispersion for descriptive reasons.

The dispersion size of the hybrid vinyl resin particles in the hybrid vinyl resin particle dispersions DB2 to DB14 was approximately 210 nm in volume median size.

Preparation of Crystalline Polyester Resin Particle Dispersion DC1

Into a 3-L reaction tank equipped with a condenser, a thermometer, a water dripper and an anchor fin (BJ-30N, Tokyo Rikakikai Co., Ltd.), 300 parts by mass of the crystalline polyester resin C1, 160 parts by mass of methyl ethyl ketone (solvent) and 100 parts by mass of isopropyl alcohol (solvent) were charged. The mixture was maintained at 70° C. in a water circulating thermostat bath and stirred at 100 rpm so that the resin was dissolved.

Thereafter, the stirring speed was changed to 150 rpm, the water circulating thermostat tank was set to 66° C. and 17 parts by mass of 10 mass % aqueous ammonia (regent) was added over 10 minutes. Then, 900 parts by mass in total of ion-exchanged water maintained at 66° C. was added dropwise at a rate of 7 parts by mass per minute to cause phase inversion so that emulsion was obtained.

Immediately, 800 parts by mass of the emulsion thus obtained and 700 parts by mass of ion-exchanged water were charged into a 2-L eggplant flask, and the flask was set to an evaporator equipped with a vacuum control unit (Tokyo Rikakikai. Co., Ltd) via a ball trap.

While being rotated, the eggplant flask was heated in a water bath at 60° C. The pressure was reduced to 7 kPa with careful attention in order to avoid bumping so that the solvent was removed. The pressure was increased to ordinary pressure when the amount of solvent collected reached 1100 parts by mass, and the eggplant flask was cooled by water so that the dispersion was obtained. The dispersion thus obtained did not have solvent odor.

The volume average particle size D50v of the resin particles of the dispersion was 130 nm. Thereafter, the solid concentration was adjusted to 20 mass % by adding ion-exchanged water. The crystalline polyester resin particle dispersion DC1 was thus obtained.

Preparation of Vinyl Resin Particle Dispersion DV1

Into a 5-L reaction vessel equipped with a stirrer, a temperature sensor, a cooling tube and a nitrogen introduction device, solution of 16 parts by mass of dodecyl sodium sulfate in 2800 parts by mass of ion-exchanged water was charged. While the solution was stirred at a stirring speed of 230 rpm under a nitrogen flow, and the inner temperature was raised to 80° C. Thereafter, solution of 20 parts by mass of potassium persulfate in 400 parts by mass of ion-exchanged water was added, and the temperature of the mixture solution was raised to 80° C. again. Thereafter, vinyl monomer solution of the following composition was added dropwise over 1 hour, and the mixture was heated and stirred for 2 hours to cause polymerization. Thereafter, the solution was cooled to 28° C. so that vinyl resin particle aqueous dispersion DV1 of a styrene-acrylate copolymer resin was prepared.

- Styrene: 400 parts by mass
- n-butyl acrylate: 236 parts by mass
- Methacryl acid: 56 parts by mass
- Methyl methacrylate: 90 parts by mass
- n-octyl-3-mercaptopropionate: 16 parts by mass Preparation of Aluminum Sulfate Aqueous Solution

- Aluminum sulfate powder (17% aluminum sulfate, Asada Chemical Industry Co., Ltd.): 35 parts by mass
- Ion-exchanged water: 1965 parts by mass The above components were charged into a 2-L vessel and were stirred at 30° C. until precipitates disappeared, so that aluminum sulfate aqueous solution was prepared.

Preparation of Toner

Preparation of Toner T1

- Amorphous polyester resin particle dispersion DA2: 800 parts by mass
- Crystalline polyester resin particle dispersion DC1: 100 parts by mass
- Hybrid vinyl resin particle dispersion DB1: 100 parts by mass
- Coloring agent dispersion: 128 parts by mass
- Releasing agent dispersion DW1: 128 parts by mass
- Ion-exchanged water: 300 parts by mass
- Anionic surfactant (DOWFAX 2A1, Dow Chemical Company): 6.5 parts by mass The above components were charged into a 3-L reaction vessel equipped with a thermometer, a pH meter and a stirrer. After the mixture was adjusted to pH 3.0 at 25° C. by adding 0.3 M nitric acid, 130 parts by mass of the prepared aluminum sulfate aqueous solution was added while the mixture was being dispersed with a homogenizer (ULTRA-TURRAX T50, IKA Corp.) at 5000 rpm so that the mixture was dispersed for 6 minutes.

Thereafter, a stirrer and a heating mantle were set to the reaction vessel, and the temperature was raised at a heating rate of 0.2° C./min until 40° C. and 0.05° C./min after 40° C. while the rotation speed is adjusted so that the slurry is sufficiently stirred. During the heating step, the particle size was measured with a MULTISIZER II (aperture size: 50 μm, Beckman Coulter Corp.) every 10 minutes.

When the volume average particle size reaches 5.3 μm, the slurry was maintained at the temperature, and the pH was adjusted to 9.0 by using 4 mass % sodium hydroxide. Thereafter, the temperature was raised to 90° C. at a heating rate of 1° C./min while the pH was adjusted to 9.0 similarly every 5° C. Then, the temperature was maintained at 90° C.

After 2.0 hours, aggregation of the particles was observed, and the vessel was cooled to 30° C. with cold water over 5 minutes.

The cooled slurry was filtered through a nylon mesh with 15 μm openings to remove bulk particles. The filtered toner slurry was adjusted to pH 6.0 by adding nitric acid and was thereafter further filtered under reduced pressure by means of an aspirator. The toner left on the filter paper was crushed as finely as possible by hand and was added to 10 times of ion-exchanged water at 30° C. After the mixture was stirred for 30 minutes, it was filtered again under reduced pressure by means of an aspirator, and the electrical conductivity of the filtrate was measured. The toner was washed by repeating this process until the electrical conductivity of the filtrate becomes 10 μS/cm or less.

The washed toner was finely crushed with a wet/dry particle sizer (COMIL) and thereafter vacuum-dried in an oven at 35° C. for 36 hours so that loner particles were obtained. Hydrophobic silica (RY50, Nippon Aerosil, Co.) (1.0 part by mass) was added to 100 parts by mass of the toner particles thus obtained, and the mixture was blended at 13000 rpm for 30 seconds with a sample mill. Thereafter, the mixture was screened with a vibrating sieve with 45 μm opening so that toner T1 was obtained.

The toner T1 thus obtained had a volume average particle size D50v of 5.5 μm, a CV value of 19% and a circularity of 0.964 (measured by FPIA-3000. Sysmex Corp.).

Preparation of Toners T2 to T6, T8 to T34

Toners T2 to T6, T8 to T34 were prepared in the same manner as the toner T1 except that the dispersions and the proportion thereof (parts by mass) were changed as listed in Table 4 and Table 5. The particle size and the circularity of the toners thus obtained are shown in Table 6.

Preparation of Toner 7

Amorphous polyester resin A1: 80 parts by mass
Crystalline polyester resin C1: 10 parts by mass
Hybrid vinyl resin B1: 10 parts by mass
Cyan Pigment (C.I. pigment blue 15:3): 7.5 parts by mass
Hydrocarbon wax (product name: FNP0090, Nippon Seiro Co., Ltd., melting temperature Tw=90.2° C.): 10 parts by mass The toner materials of the above formulation were premixed with a HENSCHEL MIXER (FM20B, Nippon Coke and Engineering, Co., Ltd.) and then melted and kneaded at a temperature of from 100° C. to 130° C. with a twin screw extruder (PCM-30, Ikegai Corp.). The kneaded material thus obtained was rolled to a thickness of 2.7 mm and was thereafter cooled to room temperature on a belt cooler and coarsely grinded to a size of from 200 to 300 μm with a hammer mill. Then, the material was finely grinded with a supersonic jet pulverizer LABOJET (Nippon Pneumatic MFG. Co., Ltd.) and was thereafter classified with an air classifier (MDS-I, Nippon Pneumatic MFG. Co., Ltd.) while the louver aperture was suitably adjusted so that the weight average particle size becomes 5.5 μm±0.2 μm. Toner base particles were thus obtained.

Hydrophobic silica (RY50, Nippon Aerosil, Co.) (1.0 part by mass) was added to 100 parts by mass of the toner base particles thus obtained, and the mixture was blended at 13000 rpm for 30 seconds with a sample mill. Thereafter, the mixture was screened with a vibrating sieve with 45 μm opening so that toner T7 was obtained.

The toner T7 thus obtained had a volume average particle size D50v of 5.5 nm, a CV value of 25% and a circularity of 0.930.

Preparation of Toner T35

Preparation of Coloring Agent Dispersion

Carbon black pigment (REGAL 330): 70 parts by mass
Nonionic surfactant (NONIPOL 400, Sanyo Chemical Industries, Ltd.): 5 parts by mass
Ion-exchanged water: 220 parts by mass The above components were mixed, dissolved and dispersed with a homogenizer (ULTRA-TURRAX T50, IKA Corp.) for 10 minutes so that coloring agent particle dispersion was prepared, which had a volume average particle size D50v of dispersed coloring agent particles of 260 nm.

Preparation of Releasing Agent Dispersion DW4

Paraffin wax (HNP0190, Nippon Seiro Co., Ltd., melting point: 85° C.): 53 parts by mass
Cationic surfactant (SANIZOL B50, Kao Corp.): 6 parts by mass
Ion-exchanged water 200 parts by mass The above components were heated at 95° C. and dispersed in a stainless-steel round flask with a homogenizer (ULTRA-TURRAX T50. IKA Corp.) for 10 minutes. Thereafter the mixture was further dispersed with a pressure jetting homogenizer. Releasing agent dispersion DW4 was thus prepared, which had a volume average particle size D50v of the dispersed releasing agent particles of 550 nm.

Preparation of Amorphous Polyester Resin Particle Dispersion DA6

Ethylene glycol: 37 parts by mass
Neopentyl glycol: 65 parts by mass
1,9-nonanediol: 32 parts by mass
Terephthalic acid: 96 parts by mass The above monomers were charged in a flask, and the temperature was raised to 200° C. over 1 hour. After checking the reaction system was being stirred, 1.2 parts by mass of dibutyltin oxide was added. Then the temperature was raised from 200° C. to 240° C. over 6 hours while generated water was being distilled away. Dehydration condensation reaction was further continued at 240° C. for 4 hours so that amorphous polyester resin A6 was obtained.

Then, the amorphous polyester resin A6 was transferred to an emulsifier "CAVITRON CD1010" (Eurotec, Ltd.) in the molten state at a transfer rate of 100 parts by mass per minute. Diluted aqueous ammonia at a concentration of 0.37 mass % was prepared by diluting aqueous ammonia regent with ion-exchanged water in another aqueous medium tank and transferred to the CAVITRON at a rate of 0.1 L/minute along with the molten polyester resin while the diluted aqueous ammonia was heated at 120° C. with a heat exchanger. Then, the CAVITRON was operated in the conditions of a rotation speed of the rotator of 60 Hz and a pressure of 5 kg/cm$^2$ so that polyester resin particle dispersion DA6 was prepared. The polyester resin particles dispersed therein had a volume average particle size of 160 nm, a solid content of 30 mass %, a glass transition temperature of 62° C. and a weight average molecular weight Mw of 13000.

Preparation of Crystalline Polyester Resin Particle Dispersion DC2

Dimethyl sebacate: 120 parts by mass
1,6-hexanediol: 57 parts by mass
Dibuthyltin oxide: 0.12 parts by mass The above components were mixed and heated to 220° C. under reduced pressure in a flask, and dehydration condensation reaction was continued for 6 hours, so that crystalline polyester resin was obtained. The resin thus obtained had a melting temperature of 68° C. and a weight average molecular weight Mw=25000.

Then, 80 parts of the crystalline polyester resin and 720 parts of deionized water were charged into a stainless-steel beaker, and the beaker was heated at 98° C. in a hot bath. After the crystalline polyester resin was melted, the mixture was stirred with a homogenizer (ULTRA-TURRAX T50, IKA Corp.) at 7000 rpm. Thereafter, 1.8 parts by mass of anionic surfactant (NEOGEN RK, 2%, DKS Co., Ltd.) was added dropwise to cause emulsification and dispersion so that crystalline polyester resin particle dispersion DC2 having an average particle size of 0.23 μm (resin particle concentration: 10 mass %) was obtained.

Preparation of Hybrid Vinyl Resin Particle Dispersion DB14

Styrene (Wako Pure Chemical Industries. Ltd.): 323 parts by mass n-butyl acrylate (Wako Pure Chemical Industries, Ltd.): 77 parts by mass 2-carboxyethyl acrylate (β-CEA, Rhodia Nikka, Ltd.): 0.2 parts by mass Dodecanediol (Wako Pure Chemical Industries, Ltd.): 6 parts by mass The dissolved mixture of the above components was emulsified and dispersed in solution of 6 parts by mass of a nonionic surfactant (NONIPOL400. Sanyo Chemical Industries, Ltd.) and 10 parts by mass of an anionic surfactant (NEOGEN SC, DKS Co., Ltd) in 550 parts by mass of ion-exchanged water in a flask. While the mixture was gently stirred, and solution of 4 parts by mass of ammonium persulfate in 50 parts by mass of ion-exchanged water was added thereto over 10 minutes. After purged with nitrogen, the mixture in the flask was stirred and heated to 70° C. in an oil bath, and emulsion polymerization was continued for 5 hours.

Preparation of Toner T35

Hybrid vinyl resin particle dispersion DB14: 37.5 parts by mass

Amorphous polyester resin particle dispersion DA6: 220 parts by mass

Crystalline polyester resin particle dispersion DC2: 80 parts by mass

Coloring agent particle dispersion DP2: 20 parts by mass

Releasing agent particle dispersion DW4: 30 parts by mass

Cationic surfactant (SANISOL B50, Kao Corp.): 1.5 parts by mass

The above components were mixed and dispersed in a round stainless-steel flask with a homogenizer (ULTRA-TURRAX T50, IKA Corp.). Thereafter, the mixture in the flask was stirred and heated to 50° C. in a heating oil bath. The temperature was maintained at 45° C. for 20 minutes. At this moment, it was confirmed that aggregate particles with an average particle size of approximately 4.8 m were formed To the mixture solution, 60 parts by mass of the hybrid vinyl resin particle dispersion DB14 was gradually added. Then, the temperature of the heating oil bath was raised to 50° C. and maintained for 30 minutes. It was confirmed that aggregate particles with an average particle size of approximately 5.8 m were formed.

After 3 parts by mass of an anionic surfactant (NEOGEN SC, DKS Co., Ltd) was added, the mixture solution was sealed in the stainless-steel flask. The mixture solution was stirred in magnetic sealing and heated to 100° C., and the temperature was maintained for 4 hours. After the solution was cooled, the reaction product was filtered, sufficiently washed with ion-exchanged water and dried so that toner particles T35 with a volume average particle size D50v of 6.4 μm was obtained.

Preparation of Developers V1 to V35

Developers V1 to V35 were produced respectively by mixing the toners T1 to T35 with an acrylic resin-coated ferrite carrier having a volume average particle size of 60 m so that the toner particle concentration becomes 6 mass %.

TABLE 1

| | MONOMER COMPONENT | | | | | |
|---|---|---|---|---|---|---|
| AMORPHOUS POLYESTER RESIN | TEREPHTHALIC ACID (parts by mass) | FUMARIC ACID (parts by mass) | DODECENYL SUCCINIC ACID (parts by mass) | TRIMELLITIC ANHYDRIDE (parts by mass) | ETHYLENE GLYCOL (parts by mass) | NEOPENTYL GLYCOL (parts by mass) |
| A1 | 55 | 15 | 30 | 2.5 | 0 | 0 |
| A2 | 70 | 10 | 25 | 0 | 0 | 0 |
| A3 | 40 | 20 | 35 | 5 | 0 | 0 |
| A4 | 70 | 10 | 25 | 0 | 0 | 0 |
| A5 | 40 | 20 | 30 | 10 | 0 | 0 |
| A6 | 96 | 0 | 0 | 0 | 37 | 65 |

| AMORPHOUS POLYESTER RESIN | MONOMER COMPONENT 1,9-NONANEDIOL (parts by mass) | BISPHENOL A ETHYLENE OXIDE (parts by mass) | BISPHENOL A PROPYLENE OXIDE (parts by mass) | DIBUTYLTIN OXIDE (parts by mass) |
|---|---|---|---|---|
| A1 | 0 | 10 | 90 | 0.05 |
| A2 | 0 | 10 | 90 | 0.05 |
| A3 | 0 | 10 | 90 | 0.05 |
| A4 | 0 | 10 | 90 | 0.05 |
| A5 | 0 | 10 | 90 | 0.05 |
| A6 | 32 | 0 | 0 | 1.20 |

TABLE 2

| HYBRID VINYL RESIN | MONOMER MATERIAL | | | | | |
|---|---|---|---|---|---|---|
| | STYRENE (parts by mass) | N-BUTYL ACRYLATE (parts by mass) | ACRYLIC ACID (parts by mass) | 2-OCTYL ACRYLATE (parts by mass) | 2-HEXYL ACRYLATE (parts by mass) | ISOSTEARYL ACRYLATE (parts by mass) |
| B1 | 400 | 90 | 8 | 2 | — | — |
| B2 | 400 | 90 | 8 | — | 2 | — |
| B3 | 400 | 90 | 8 | — | — | 2 |
| B4 | 400 | 90 | 8 | — | — | — |
| B5 | 400 | 90 | 8 | — | — | — |
| B6 | 400 | 90 | 8 | 2 | — | — |
| B7 | 400 | 90 | 8 | 2 | — | — |
| B8 | 400 | 90 | 8 | 2 | — | — |
| B9 | 400 | 90 | 0 | 2 | — | — |
| B10 | 400 | 90 | 8 | 2 | — | — |
| B11 | 400 | 90 | 8 | 2 | — | — |
| B12 | 400 | 90 | 8 | 2 | — | — |
| B13 | 400 | 90 | 8 | — | — | — |
| B14 | 323 | 77 | — | — | — | — |

| HYBRID VINYL RESIN | MONOMER MATERIAL | | | | |
|---|---|---|---|---|---|
| | 2-BEHENYL ACRYLATE (parts by mass) | 2-ETHYLHEXYL ACRYLATE (parts by mass) | 2-HYDROXYETHYL ACRYLATE (parts by mass) | ETHYL ACRYLATE (parts by mass) | 2-CARBOXY ETHYL ACRYLATE (parts by mass) |
| B1 | — | — | — | — | — |
| B2 | — | — | — | — | — |
| B3 | — | — | — | — | — |
| B4 | 2 | — | — | — | — |
| B5 | — | 2 | — | — | — |
| B6 | — | — | — | — | — |
| B7 | — | — | — | — | — |
| B8 | — | — | — | — | — |
| B9 | — | — | 8 | — | — |
| B10 | — | — | — | — | — |
| B11 | — | — | — | — | — |
| B12 | — | — | — | — | — |
| B13 | — | — | — | 2 | — |
| B14 | — | — | — | — | 0.2 |

| HYBIRID VINYL RESIN | ACID MONOMER MATERIAL | | | ALCOHOL MONOMER | |
|---|---|---|---|---|---|
| | TEREPHTHALIC ACID (parts by mass) | FUMARIC ACID (parts by mass) | DODECENYL SUCCINIC ACID (parts by mass) | BISPHENOL A ETHYLENE OXIDE (parts by mass) | BISPHENOL A PROPYLENE OXIDE (parts by mass) |
| B1 | 32 | 3 | 19 | 10 | 79 |
| B2 | 32 | 3 | 19 | 10 | 78 |
| B3 | 32 | 3 | 19 | 10 | 79 |
| B4 | 32 | 3 | 19 | 10 | 79 |
| B5 | 32 | 3 | 19 | 10 | 79 |
| B6 | 8 | 1 | 5 | 2 | 20 |
| B7 | 49 | 5 | 28 | 14 | 119 |
| B8 | 65 | 6 | 37 | 19 | 159 |
| B9 | — | — | — | — | — |
| B10 | 32 | 3 | 19 | 10 | 79 |
| B11 | 32 | 3 | 19 | 10 | 79 |
| B12 | — | — | — | — | — |
| B13 | 32 | 3 | 19 | 10 | 79 |
| B14 | — | — | — | — | — |

| HYBIRID VINYL RESIN | HEXAMETHYLENE DIISOCYANATE (parts by mass) | DIBUTYLTIN OXIDE (parts by mass) | CONTENT OF VINYL POLYMER SEGMENT (mass %) |
|---|---|---|---|
| B1 | — | 0.03 | 80 |
| B2 | — | 0.03 | 80 |
| B3 | — | 0.03 | 80 |
| B4 | — | 0.03 | 80 |
| B5 | — | 0.03 | 80 |
| B6 | — | 0.01 | 95 |
| B7 | — | 0.05 | 70 |
| B8 | — | 0.07 | 60 |
| B9 | 36 | — | 95 |
| B10 | — | 0.03 | 80 |
| B11 | — | 0.03 | 80 |
| B12 | — | — | 100 |

TABLE 2-continued

| | | | |
|---|---|---|---|
| B13 | — | 0.03 | 80 |
| B14 | — | — | 100 |

TABLE 3

| CRYSTALLINE POLYESTER RESIN | 1,10-DODECANEDIOIC ACID (parts by mass) | 1,9-NONANEDIOL (parts by mass) | DIBUTYLTIN OXIDE (parts by mass) | DIMETHYL CEBACATE (parts by mass) | 1,6-HEXANEDIOL (parts by mass) | DIBUTYLTIN OXIDE (parts by mass) |
|---|---|---|---|---|---|---|
| C1 | 120 | 77 | 0.12 | 0 | 0 | 0 |
| C2 | 0 | 0 | 0 | 120 | 57 | 0.12 |

TABLE 4

| HYBRID VINYL RESIN DISPERSION | CONTENT OF VINYL POLYMER SEGMENT (mass %) | NON-VINYL POLYMER SEGMENT CONTENT (mass %) | NON-VINYL POLYMER SEGMENT TYPE | NON-VINYL POLYMER SEGMENT STRUCTURE | MONOMER HAVING STRUCTURE OF GENERAL FORMULA (1) COMPOUND | $R_1$ | $R_2$ ALKYL STRUCTURE | $R_2$ NUMBER OF CARBON ATOMS |
|---|---|---|---|---|---|---|---|---|
| DB1 | 8.0 | 2.0 | POLYESTER | A | 2-OCTYL ACRYLATE | H | STRAIGHT CHAIN | 8 |
| DB2 | 8.0 | 2.0 | POLYESTER | A | 2-HEXYL ACRYLATE | H | STRAIGHT CHAIN | 6 |
| DB3 | 8.0 | 2.0 | POLYESTER | A | ISOSTEARYL ACRYLATE | H | STRAIGHT CHAIN | 18 |
| DB4 | 8.0 | 2.0 | POLYESTER | A | 2-BEHENYL ACRYLATE | H | STRAIGHT CHAIN | 22 |
| DB5 | 8.0 | 2.0 | POLYESTER | A | 2-ETHYLHEXYL ACRYLATE | H | BRANCHED | 9 |
| DB6 | 8.0 | 0.4 | POLYESTER | A | 2-OCTYL ACRYLATE | H | STRAIGHT CHAIN | 8 |
| DB7 | 8.0 | 3.4 | POLYESTER | A | 2-OCTYL ACRYLATE | H | STRAIGHT CHAIN | 8 |
| DB8 | 8.0 | 5.3 | POLYESTER | A | 2-OCTYL ACRYLATE | H | STRAIGHT CHAIN | 8 |
| DB9 | 8.0 | 2.0 | URETHANE | A | 2-OCTYL ACRYLATE | H | STRAIGHT CHAIN | 8 |
| DB10 | 8.0 | 2.0 | POLYESTER | B | 2-OCTYL ACRYLATE | H | STRAIGHT CHAIN | 8 |
| DB11 | 8.0 | 2.0 | POLYESTER | C | 2-OCTYL ACRYLATE | H | STRAIGHT CHAIN | 8 |
| DB12 | 8.0 | — | — | — | 2-OCTYL ACRYLATE | H | STRAIGHT CHAIN | 8 |
| DB13 | 8.0 | 2.0 | POLYESTER | A | BUTYL ACRYLATE | H | STRAIGHT CHAIN | 4 |
| DB14 | 16.7 | — | — | — | 2-CARBOXYETHYL ACRYLATE | H | STRAIGHT CHAIN | 3 |

A: GRAFT

B: PES MAIN CHAIN AND VINYL SIDE CHAIN

C: MODIFIED TERMINAL

TABLE 5-1

| | BINDER RESIN | | | | |
|---|---|---|---|---|---|
| | | | HYBRID VINYL RESIN | | |
| | AMORPHOUS POLYESTER RESIN | | | | |
| TONER NO. | DISPERSION | CONTENT (parts by mass) | DISPERSION | CONTENT (WHOLE) (parts by mass) | CONTENT OF VINYL POLYMER SEGMENT IN HYBRID VINYL RESIN (parts by mass) |
| T1 | DA2 | 80.0 | DB1 | 10.0 | 80 |
| T2 | DA3 | 80.0 | DB1 | 10.0 | 80 |
| T3 | DA1 | 80.0 | DB1 | 10.0 | 80 |
| T4 | DA1 | 80.0 | DB1 | 10.0 | 80 |
| T5 | DA1 | 80.0 | DB1 | 10.0 | 80 |
| T6 | DA1 | 80.0 | DB1 | 10.0 | 80 |
| T7 | A1 | 80.0 | B1 | 10.0 | 80 |
| T8 | DA1 | 80.0 | DB2 | 10.0 | 80 |
| T9 | DA1 | 80.0 | DB3 | 10.0 | 80 |
| T10 | DA1 | 80.0 | DB4 | 10.0 | 80 |
| T11 | DA1 | 80.0 | DB5 | 10.0 | 80 |
| T12 | DA1 | 80.0 | DB1 | 10.0 | 80 |
| T13 | DA1 | 80.0 | DB1 | 10.0 | 80 |
| T14 | DA1 | 87.5 | DB1 | 2.5 | 80 |
| T15 | DA1 | 83.7 | DB1 | 6.3 | 80 |
| T16 | DA1 | 65.0 | DB1 | 25.0 | 80 |
| T17 | DA1 | 28.7 | DB1 | 61.3 | 80 |
| T18 | DA1 | 85.0 | DB1 | 10.0 | 80 |
| T19 | DA1 | 60.0 | DB1 | 10.0 | 80 |
| T20 | DA1 | 50.0 | DB1 | 10.0 | 80 |
| T21 | DA1 | 81.6 | DB6 | 8.4 | 95 |
| T22 | DA1 | 78.6 | DB7 | 11.4 | 70 |
| T23 | DA1 | 76.7 | DB8 | 13.3 | 60 |
| T24 | DA1 | 80.0 | DB9 | 10.0 | 80 |
| T25 | DA1 | 80.0 | DB10 | 10.0 | 80 |
| T26 | DA1 | 80.0 | DB11 | 10.0 | 80 |

| | BINDER RESIN CRYSTALLINE POLYESTER RESIN | | RELEASING AGENT | | |
|---|---|---|---|---|---|
| TONER NO. | DISPERSION | CONTENT (parts by mass) | DISPERSION | TYPE | REMARKS |
| T1 | DC1 | 10.0 | DW1 | FNP0090 | INVENTION |
| T2 | DC1 | 10.0 | DW1 | FNP0090 | INVENTION |
| T3 | DC1 | 10.0 | DW1 | FNP0090 | INVENTION |
| T4 | DC1 | 10.0 | DW1 | FNP0090 | INVENTION |
| T5 | DC1 | 10.0 | DW1 | FNP0090 | INVENTION |
| T6 | DC1 | 10.0 | DW1 | FNP0090 | INVENTION |
| T7 | C1 | 10.0 | W1 | FNP0090 | INVENTION |
| T8 | DC1 | 10.0 | DW1 | FNP0090 | INVENTION |
| T9 | DC1 | 10.0 | DW1 | FNP0090 | INVENTION |
| T10 | DC1 | 10.0 | DW1 | FNP0090 | INVENTION |
| T11 | DC1 | 10.0 | DW1 | FNP0090 | INVENTION |
| T12 | DC1 | 10.0 | DW2 | WEP-3 | INVENTION |
| T13 | DC1 | 10.0 | DW3 | AMIDE WAX | INVENTION |
| T14 | DC1 | 10.0 | DW1 | FNP0090 | INVENTION |
| T15 | DC1 | 10.0 | DW1 | FNP0090 | INVENTION |
| T16 | DC1 | 10.0 | DW1 | FNP0090 | INVENTION |
| T17 | DC1 | 10.0 | DW1 | FNP0090 | INVENTION |
| T18 | DC1 | 5.0 | DW1 | FNP0090 | INVENTION |
| T19 | DC1 | 30.0 | DW1 | FNP0090 | INVENTION |
| T20 | DC1 | 40.0 | DW1 | FNP0090 | INVENTION |
| T21 | DC1 | 10.0 | DW1 | FNP0090 | INVENTION |
| T22 | DC1 | 10.0 | DW1 | FNP0090 | INVENTION |
| T23 | DC1 | 10.0 | DW1 | FNP0090 | INVENTION |
| T24 | DC1 | 10.0 | DW1 | FNP0090 | INVENTION |
| T25 | DC1 | 10.0 | DW1 | FNP0090 | INVENTION |
| T26 | DC1 | 10.0 | DW1 | FNP0090 | INVENTION |

TABLE 5-2

| | BINDER RESIN | | | | |
|---|---|---|---|---|---|
| | | | HYBRID VINYL RESIN | | |
| | AMORPHOUS POLYESTER RESIN | | | CONTENT | CONTENT OF VINYL POLYMER SEGMENT IN |
| TONER NO. | DISPERSION | CONTENT (parts by mass) | DISPERSION | (WHOLE) (parts by mass) | HYBRID VINYL RESIN (parts by mass) |
| T27 | DV1 | 80.0 | DB1 | 10.0 | 80 |
| T28 | DA1 | 80.0 | DB1 | 10.0 | 80 |
| T29 | DA1 | 90.0 | — | — | — |
| T30 | DA1 | 82.0 | DB12 | 8.0 | 100 |
| T31 | DA1 | 80.0 | DB1 | 10.0 | 80 |
| T32 | DA1 | 80.0 | DB13 | 10.0 | 80 |
| T33 | DA4 | 80.0 | DB1 | 10.0 | 80 |
| T34 | DA5 | 80.0 | DB1 | 10.0 | 80 |
| T35 | DA6 | 73.3 | DB14 | 16.7 | 100 |

| | BINDER RESIN CRYSTALLINE POLYESTER RESIN | | | RELEASING AGENT | | |
|---|---|---|---|---|---|---|
| TONER NO. | DISPERSION | CONTENT (parts by mass) | DISPERSION | TYPE | REMARKS |
| T27 | DC1 | 10.0 | DW1 | FNP0090 | COMPARISON |
| T28 | DC1 | 0.0 | DW1 | FNP0090 | COMPARISON |
| T29 | DC1 | 10.0 | DW1 | FNP0090 | COMPARISON |
| T30 | DC1 | 10.0 | DW1 | FNP0090 | COMPARISON |
| T31 | DC1 | 10.0 | DW1 | FNP0090 | COMPARISON |
| T32 | DC1 | 10.0 | DW1 | FNP0090 | COMPARISON |
| T33 | DC1 | 10.0 | DW1 | FNP0090 | COMPARISON |
| T34 | DC1 | 10.0 | DW1 | FNP0090 | COMPARISON |
| T35 | DC2 | 3.3 | DW4 | HNP0190 | COMPARISON |

Evaluation Methods

Volume Average Particle Size of Particles in Dispersion

The volume average particle size of resin particles, coloring agent particles and the like was measured with a laser diffraction particle size measuring device (LA700, Horiba, Ltd.).

Volume Average Particle Size and CV Value of Toner

The volume average particle size and the CV value of the toner particles were measured with COULTER MULTISIZER-II (Beckman Coulter Corp.). The electrolyte used was "ISOTON II" (Beckman Coulter Corp.).

Circularity of Toner

The circularity of the toners was measured with an FPIA-3000 (Sysmex Corp.). Toner dispersion for the measurement was prepared as follows. First, 30 mL of ion-exchanged water is charged into a 100-mL beaker, and two drops of a surfactant was added thereto as a dispersant. A toner (20 mg) was added to the solution and was subjected to ultrasonic dispersion for 3 minutes so that the dispersion was prepared.

The toner dispersion thus obtained was subjected to a measurement with an FPIA-3000, in which 4500 particles were measured to calculate the circularity.

Storage Stability of Toner

The storage stability of the toners was evaluated by the anti-blocking property of the toners when they were placed in an oven at 50° C. for 1 week. To make the evaluation, the degree of aggregation was visually observed.

The evaluation criteria for the degree of aggregation of the toners is shown below. A to D are acceptable.

A: No aggregate was observed, and the fluidity was very high.

B: No aggregate was observed.

C: Some aggregates were observed but were readily crushable.

D: Aggregates were crushable with a developer stirrer. (Moderate)

E: Aggregates were not sufficiently crushed with a developer stirrer. (Rather poor)

Low-Temperature Fixability (Under Offset Temperature)

The above-described developers V1 to V35 were loaded to a commercially available printer of a full-color copier "BIZHUB PRO (registered trademark) C6501" (Konica Minolta. Inc.), in which the fixing device was altered so that the surface temperature of the fixing heat roller is changeable within the range of 80° C. to 210° C. in the environment of ordinary temperature and ordinary humidity (20° C., 50% RH). A fixing test of fixing a black solid image at a toner amount of 8 mg/10 $cm^2$ on a paper (LETHEAC 75, grain short, ream weight: 130 kg, Takeo Co., Ltd) was repeated while the fixing temperature setting is increased from 80° C. to 150° C. in 5° C. increments.

Then, the printed matter that was obtained in the fixing test at the respective temperatures was visually observed, and a fixable temperature lower limit was defined as the lowest surface temperature of a fixing belt at which no cold offset was visually observed, so that the low-temperature fixability was evaluated. Toners with a fixable temperature lower limit of 155° C. or less are practically acceptable.

Image Quality

By using a commercially available printer of a full-color copier "BIZHUB PRO (registered trademark) C1100 (Konica Minolta, Inc.), an evaluation chart with a coverage rate of 5% was successively printed on 1000 sheets of paper (LETHEAC 75, grain short, ream weight: 130 kg, Takeo Co., Ltd) in the environment of 20° C. and 50% RH at a printing speed of 100 sheets/min. The image was formed on long-edge fed A4 sheets at an output resolution of 1200 dpi by one dot-one space. The printed sheets were collected every one of 100 sheets, and the dot reproducibility was evaluated by visual observation. Rank 2 to Rank 5 are acceptable.

Evaluation Criteria

Rank 5: No disarray of dots or scattering were observed in all charts.

Rank 4: Slight disarray of dots was observed under magnification after 800 sheets of continuous printing, but no scattering was observed.

Rank 3: Slight disarray of dots was observed under magnification after 300 sheets of continuous printing, but no scattering was observed.

Rank 2: Disarray of dots was observed under magnification even at the start of continuous printing.

Rank 1: Obvious disarray and scattering of dots were visually observed.

TABLE 6

| DEVELOPER NO. | TONER NO. | VOLUME AVERAGE PARTICLE SIZE D50V (μm) | CV VALUE (%) | CIRCULARITY | MOLECULAR WEIGHT MAIN PEAK OF THF SOLUBLE FRACTION | REMARKS |
|---|---|---|---|---|---|---|
| V1 | T1 | 5.5 | 19 | 0.964 | 11000 | INVENTION |
| V2 | T2 | 5.5 | 19 | 0.964 | 30000 | INVENTION |
| V3 | T3 | 5.5 | 19 | 0.930 | 13000 | INVENTION |
| V4 | T4 | 5.5 | 19 | 0.942 | 13000 | INVENTION |
| V5 | T5 | 5.5 | 19 | 0.964 | 13000 | INVENTION |
| V6 | T6 | 5.5 | 19 | 0.990 | 13000 | INVENTION |
| V7 | T7 | 5.5 | 25 | 0.930 | 13000 | INVENTION |
| V8 | T8 | 5.5 | 19 | 0.964 | 13000 | INVENTION |
| V9 | T9 | 5.5 | 19 | 0.964 | 13000 | INVENTION |
| V10 | T10 | 5.5 | 19 | 0.964 | 13000 | INVENTION |
| V11 | T11 | 5.5 | 19 | 0.964 | 13000 | INVENTION |
| V12 | T12 | 5.5 | 19 | 0.964 | 13000 | INVENTION |
| V13 | T13 | 5.5 | 19 | 0.964 | 13000 | INVENTION |
| V14 | T14 | 5.5 | 19 | 0.964 | 13000 | INVENTION |
| V15 | T15 | 5.5 | 19 | 0.964 | 13000 | INVENTION |
| V16 | T16 | 5.5 | 19 | 0.964 | 13000 | INVENTION |
| V17 | T17 | 5.5 | 19 | 0.964 | 13000 | INVENTION |
| V18 | T18 | 5.5 | 19 | 0.964 | 13000 | INVENTION |
| V19 | T19 | 5.5 | 19 | 0.964 | 13000 | INVENTION |
| V20 | T20 | 5.5 | 19 | 0.964 | 13000 | INVENTION |
| V21 | T21 | 5.5 | 19 | 0.964 | 13000 | INVENTION |
| V22 | T22 | 5.5 | 19 | 0.964 | 13000 | INVENTION |
| V23 | T23 | 5.5 | 19 | 0.964 | 13000 | INVENTION |
| V24 | T24 | 5.5 | 19 | 0.964 | 13000 | INVENTION |
| V25 | T25 | 5.5 | 19 | 0.964 | 13000 | INVENTION |
| V26 | T26 | 5.5 | 19 | 0.964 | 13000 | INVENTION |
| V27 | T27 | 5.5 | 19 | 0.964 | 13000 | COMPARISON |
| V28 | T28 | 5.5 | 19 | 0.964 | 13000 | COMPARISON |
| V29 | T29 | 5.5 | 19 | 0.964 | 13000 | COMPARISON |
| V30 | T30 | 5.5 | 19 | 0.964 | 13000 | COMPARISON |
| V31 | T31 | 5.5 | 19 | 0.964 | 13000 | COMPARISON |
| V32 | T32 | 5.5 | 19 | 0.964 | 13000 | COMPARISON |
| V33 | T33 | 5.5 | 19 | 0.964 | 10000 | COMPARISON |
| V34 | T34 | 5.5 | 19 | 0.964 | 40000 | COMPARISON |
| V35 | T35 | 5.5 | 25 | 0.930 | 10000 | COMPARISON |

TABLE 7

| DEVELOPER NO. | TONER NO. | TONER STORAGE STABILITY | LOW-TEMPERATURE FIXABILITY (UNDER OFFSET TEMPERATURE) | IMAGE QUALITY (RANK) | REMARKS |
|---|---|---|---|---|---|
| V1 | T1 | C | 125 | 3 | INVENTION |
| V2 | T2 | A | 155 | 3 | INVENTION |
| V3 | T3 | B | 130 | 2 | INVENTION |
| V4 | T4 | B | 130 | 5 | INVENTION |
| V5 | T5 | A | 130 | 5 | INVENTION |
| V6 | T6 | A | 130 | 5 | INVENTION |
| V7 | T7 | B | 135 | 2 | INVENTION |
| V8 | T8 | A | 140 | 2 | INVENTION |
| V9 | T9 | A | 145 | 3 | INVENTION |
| V10 | T10 | A | 150 | 4 | INVENTION |
| V11 | T11 | A | 135 | 3 | INVENTION |
| V12 | T12 | A | 130 | 4 | INVENTION |
| V13 | T13 | A | 145 | 3 | INVENTION |
| V14 | T14 | C | 130 | 2 | INVENTION |

TABLE 7-continued

| DEVELOPER NO. | TONER NO. | TONER STORAGE STABILITY | LOW-TEMPERATURE FIXABILITY (UNDER OFFSET TEMPERATURE) | IMAGE QUALITY (RANK) | REMARKS |
|---|---|---|---|---|---|
| V15 | T15 | C | 130 | 3 | INVENTION |
| V16 | T16 | A | 145 | 4 | INVENTION |
| V17 | T17 | A | 150 | 5 | INVENTION |
| V18 | T18 | A | 155 | 4 | INVENTION |
| V19 | T19 | C | 130 | 4 | INVENTION |
| V20 | T20 | D | 125 | 4 | INVENTION |
| V21 | T21 | A | 140 | 5 | INVENTION |
| V22 | T22 | A | 130 | 3 | INVENTION |
| V23 | T23 | A | 130 | 2 | INVENTION |
| V24 | T24 | A | 150 | 3 | INVENTION |
| V25 | T25 | C | 140 | 3 | INVENTION |
| V26 | T26 | C | 140 | 2 | INVENTION |
| V27 | T27 | D | 160 | 3 | COMPARISON |
| V28 | T28 | A | 160 | 3 | COMPARISON |
| V29 | T29 | E | 150 | 1 | COMPARISON |
| V30 | T30 | A | 155 | 1 | COMPARISON |
| V31 | T31 | A | 155 | 1 | COMPARISON |
| V32 | T32 | D | 160 | 1 | COMPARISON |
| V33 | T33 | E | 125 | 3 | COMPARISON |
| V34 | T34 | A | 165 | 3 | COMPARISON |
| V35 | T35 | E | 125 | 2 | COMPARISON |

As seen in the above evaluation results, it was found that it is possible to obtain fine images without the occurrence of a transfer error or a fixing error when the electrostatic latent image developing toner of the present invention is used for printing.

Although embodiments of the present invention have been described and illustrated in detail, it is clearly understood that the same is by way of illustration and example only and not limitation, the scope of the present invention should be interpreted by terms of the appended claims.

Japanese patent application No. 2016-190877 filed on Sep. 29, 2016, including description, claims, drawings, and abstract the entire disclosure is incorporated herein by reference in its entirety.

What is claimed is:

1. An electrostatic latent image developing toner, comprising:

toner particles which comprises a binder resin and a releasing agent, wherein a main component of the binder resin is a polyester resin, wherein the binder resin comprises a crystalline polyester resin, an amorphous polyester resin and a hybrid vinyl resin, wherein the hybrid vinyl resin is composed of a vinyl polymer segment and at least one segment selected from the group consisting of a polyester polymer segment, a urethane polymer segment, and a urea polymer segment which is chemically bound to the vinyl polymer segment, wherein a content of the vinyl polymer segment of the hybrid vinyl resin is within the range of 1 to 20 mass % with respect to the binder resin, wherein a main component of the hybrid vinyl resin is the vinyl polymer segment which comprises a structural unit derived from a monomer of a following formula (1), $$H_2C{=}CR_1{-}COOR_2 \quad (1)$$

where $R_1$ is a hydrogen atom or a methyl group, and $R_2$ is a long-chain alkyl group of 6 carbon atoms or more, and wherein a tetrahydrofuran-soluble fraction of the toner has a main peak of a molecular weight distribution measured by gel permeation chromatography within a range of 11000 to 30000.

2. The electrostatic latent image developing toner according to claim 1, wherein an average circularity of the toner particles is within the range of 0.940 to 0.995, and wherein a coefficient of variation of a number particle size distribution of the toner particles is equal to or less than 20%.

3. The electrostatic latent image developing toner according to claim 1, wherein the number of carbon atoms of the long-chain alkyl group of $R_2$ is equal to or less than 20.

4. The electrostatic latent image developing toner according to claim 1, wherein the number of carbon atoms of the long-chain alkyl group of $R_2$ is within the range of 8 to 18.

5. The electrostatic latent image developing toner according to claim 1, wherein the long-chain alkyl group of $R_2$ comprises a branched structure.

6. The electrostatic latent image developing toner according to claim 1, wherein the releasing agent comprises a hydrocarbon releasing agent.

7. The electrostatic latent image developing toner according to claim 1, wherein the releasing agent comprises an ester releasing agent.

8. The electrostatic latent image developing toner according to claim 1, wherein the content of the vinyl polymer segment of the hybrid vinyl resin is within the range of 5 to 20 mass % with respect to the binder resin.

9. The electrostatic latent image developing toner according to claim 1, wherein a content of the crystalline polyester resin is within the range of 1 to 30 mass % with respect to the binder resin.

10. The electrostatic latent image developing toner according to claim 1, wherein a content of the vinyl polymer segment in the hybrid vinyl resin is within the range of 65 to 90 mass %.

11. The electrostatic latent image developing toner according to claim 1, wherein said at least one segment comprises the polyester polymer segment.

12. The electrostatic latent image developing toner according to claim 1, wherein the hybrid vinyl resin is a block copolymer of the vinyl polymer segment and said at least one segment.

13. The electrostatic latent image developing toner according to claim 1, wherein the hybrid vinyl resin comprises a main chain of the vinyl polymer segment and a side chain of said at least one segment.

14. An electrostatic latent image developing toner, comprising:

toner particles which comprises a binder resin and a releasing agent, wherein a main component of the binder resin is a polyester resin, wherein the binder resin comprises a crystalline polyester resin, an amorphous polyester resin and a hybrid vinyl resin, wherein the hybrid vinyl resin is composed of a vinyl polymer segment and at least one segment selected from the group consisting of a polyester polymer segment, a urethane polymer segment, and a urea polymer segment which is chemically bound to the vinyl polymer segment, wherein a content of the vinyl polymer segment in the hybrid vinyl resin is within the range of 65 to 90 mass %, wherein a main component of the hybrid vinyl resin is the vinyl polymer segment which comprises a structural unit derived from a monomer of a following formula (1), $$H_2C{=}CR_1{-}COOR_2 \quad (1)$$

where $R_1$ is a hydrogen atom or a methyl group, and $R_2$ is a long-chain alkyl group of 6 carbon atoms or more, and wherein a tetrahydrofuran-soluble fraction of the toner has a main peak of a molecular weight distribution measured by gel permeation chromatography within a range of 11000 to 30000.

15. The electrostatic latent image developing toner according to claim 14, wherein an average circularity of the toner particles is within the range of 0.940 to 0.995, and wherein a coefficient of variation of a number particle size distribution of the toner particles is equal to or less than 20%.

16. The electrostatic latent image developing toner according to claim 14, wherein the number of carbon atoms of the long-chain alkyl group of $R_2$ is equal to or less than 20.

17. The electrostatic latent image developing toner according to claim 14, wherein the number of carbon atoms of the long-chain alkyl group of $R_2$ is within the range of 8 to 18.

18. The electrostatic latent image developing toner according to claim 14, wherein the long-chain alkyl group of $R_2$ comprises a branched structure.

19. The electrostatic latent image developing toner according to claim 14, wherein the releasing agent comprises a hydrocarbon releasing agent.

20. The electrostatic latent image developing toner according to claim 14, wherein the releasing agent comprises an ester releasing agent.

* * * * *